US009661901B2

(12) United States Patent
Yamazaki et al.

(10) Patent No.: US 9,661,901 B2
(45) Date of Patent: May 30, 2017

(54) SLIDER AND HANDLING TOOL FOR SLIDER

(71) Applicant: YKK Corporation, Tokyo (JP)

(72) Inventors: Makoto Yamazaki, Toyama (JP); Yuichi Yamashita, Toyama (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 15/086,003

(22) Filed: Mar. 30, 2016

(65) Prior Publication Data

US 2016/0295973 A1 Oct. 13, 2016

(30) Foreign Application Priority Data

Apr. 9, 2015 (JP) ..... 2015-080269

(51) Int. Cl.

| | |
|---|---|
| ***A44B 19/00*** | (2006.01) |
| ***B25B 7/02*** | (2006.01) |
| ***A44B 19/26*** | (2006.01) |
| *A47G 25/90* | (2006.01) |

(52) U.S. Cl.

CPC ..... *A44B 19/26* (2013.01); *B25B 7/02* (2013.01); *A47G 25/902* (2013.01)

(58) Field of Classification Search

CPC ..... A44B 19/26; A44B 19/262; A44B 19/285; A47G 25/902; B25B 7/00; B25B 7/02

USPC ..... 294/3.6, 16, 118; 24/429

See application file for complete search history.

(56) References Cited

U.S. PATENT DOCUMENTS 1,116,249 A * 11/1914 Denner-Meier ..... A44B 19/04 24/381
1,452,372 A * 4/1923 Gomez ..... A44B 19/285 24/381
3,249,977 A * 5/1966 Cloud, Sr. ..... A47G 25/902 294/26
3,276,087 A * 10/1966 Hanson ..... A47G 25/902 294/104
3,283,381 A * 11/1966 Hurst ..... A47G 25/902 294/26
3,355,779 A * 12/1967 Hurst ..... A47G 25/902 294/3.6
3,745,636 A * 7/1973 Burstein ..... A44B 19/64 269/254 R
3,808,665 A * 5/1974 Bannies ..... A44B 19/285 29/243.5
4,027,369 A * 6/1977 Kando ..... A44B 19/285 29/270

(Continued)

FOREIGN PATENT DOCUMENTS

JP 06-209809 A 8/1994
JP 2528168 Y 12/1996

*Primary Examiner* — Dean Kramer
(74) *Attorney, Agent, or Firm* — Kilpatrick Townsend & Stockton LLP

(57) ABSTRACT

Provided is a slider which is lightweight, reduces production cost and is excellent in quietness, the slider having a slider body which is hardly deformed or broken. The slider includes a slider body made of synthetic resin and a slider handling tool which holds a top and bottom of the slider body and performs sliding operation. The slider handling tool has first and second arm parts connecting with a connecting axis part and first and second holding parts disposed at a tip end part of the first and second arm parts, respectively.

12 Claims, 12 Drawing Sheets

(56) References Cited

U.S. PATENT DOCUMENTS

| | | | | |
|---|---|---|---|---|
| 5,086,546 | A * | 2/1992 | Aoki | A44B 19/26 24/429 |
| 8,371,003 | B2 * | 2/2013 | Arney | A47G 25/902 24/427 |
| 2008/0229555 | A1 * | 9/2008 | Keyaki | A44B 19/308 24/429 |
| 2014/0109366 | A1 * | 4/2014 | Dhubb | B25B 7/00 29/33.2 |

* cited by examiner

SLIDER AND HANDLING TOOL FOR SLIDER

CROSS-REFERENCE TO RELATED APPLICATION

The present application claims priority of Japanese Patent Application No. 2015-080269, filed on Apr. 9, 2015 and entitled "Slider and Handling Tool for Slider", the entire contents of which are hereby incorporated by reference.

TECHNICAL FIELD

The invention relates to a slider in which a slider body without having a tab is operated to slide with a handling tool formed independently from the slider body.

BACKGROUND ART

Generally, a slide fastener includes a pair of left and right fastener stringers in which element rows are formed on side edges facing each other of left and right fastener tapes along a length direction of the tape, and a slider attached to the element rows in a slidable manner. By sliding the slider along the element rows in a coupling direction or a separating direction of fastener elements, the slide fastener can be closed or opened.

A slider generally includes a slider body and a tab rotatably attached to the slider body. The slider body and the tab are formed of synthetic resin or metal. The slider body includes an upper blade part (upper wing plate), a lower blade part (lower wing plate) which is separated from and disposed in parallel with the upper blade part, a guide post connecting both front ends (shoulder opening side end parts) of the upper blade part and the lower blade part, and a tab attaching rod provided on an upper surface of the upper blade part. The tab is attached to the tab attaching rod in the slider body.

For using a slide fastener having such a slider, a user slides the slider by holding the tab with his fingers and pulling the slider in a coupling or a separating direction of the fastener element to open or close the slide fastener. That means, the user can perform a sliding operation easily and stably because the tab is attached to the slider body.

Meanwhile, Japanese Utility Model Registration No. 2,528,168 Specification (Patent Document 1) discloses a slide fastener in which a slider body without having a tab is operated to slide with a tab tool formed independently from the slider body, as a slide fastener used for a cloth for a nursery care receiver.

FIG. 18 shows a cross-sectional view of the slider body described in Patent Document 1. The slider body 90 has a body main part 91, a cover body 92 mounted on the body main part 91, a plate spring member 93 held in the cover body 92, and a stopping pawl body 94 pivoted by the body main part 91 and biased by the plate spring member 93. However, a tab is not attached to the slider body 90.

In Patent Document 1, the body main part 91 has an upper blade part 91*a*, a lower blade part 91*b*, a connecting post 91*c* connecting both front ends of the upper blade part 91*a* and the lower blade part 91*b*, a flange part 91*d* disposed on left and right side edge parts of the upper blade part 91*a* and the lower blade part 91*b* and a pair of front and rear attaching posts 91*e* erecting on a front end part and a rear end part respectively of an upper surface of the upper blade part 91*a*.

An element guideway through which element rows of the slide fastener passes is formed between the upper blade part 91*a* and the lower blade part 91*b* in the body main part 91, and a pawl hole 91*f* penetrating from an upper surface side of the upper blade part 91*a* to the element guideway is formed between the pair of front and rear attaching posts 91*e*.

The cover body 92 has a ceiling part, a front wall part, a rear wall part and left and right side wall parts. An inside of the cover body 92 is hollow. On the left and right wall parts in the cover body 92 for entering and exiting a pin 96*d*, as mentioned below, of a tab tool 96 are formed, but not shown. The plate spring member 93 is held on the ceiling of the cover body 92 to bend downward.

The stopping pawl body 94 has a main body part 94*a* having a substantially U-shape and a stopping pawl part 94*b* extending downward from an edge part of the main body part 94*a*. The stopping pawl body 94 is pivotably supported to the front attaching post 91*e* on the body main part 91 with a pivot 95. As the stopping pawl body 94 is biased downward by the plate spring member 93, the stopping pawl part 94*b* is protruded in the element guideway through the pawl hole 91*f* in the upper blade part 91*a*.

As the stopping pawl part 94*b* in the stopping pawl body 94 is protruded in the element guideway, the stopping pawl part 94*b* can be engaged with the fastener element in the element rows passing through the element guideway, which are not shown. With the above, the slider body 90 can keep a stopped state not to move with respect to the element rows of the slide fastener.

The tab tool 96 for a sliding operation of the slider body 90 without having a tab along the element rows has a shape like nippers in which a pair of first and second arm parts 96*a* and 96*b* are swingably connected at a connecting axis part 96*c*, as shown in FIG. 19.

The first and second arm parts 96*a* and 96*b* each has a grip part disposed on an end part and a holding part disposed on the other end part, respectively. The holding part of the first and second arm parts 96*a* and 96*b* is provided with a pair of pins 96*d* protruding inward. A spring 96*e* biasing the grip part of the first arm part 96*a* and the grip part of the second arm part 96*b* in an opening direction is disposed near the connecting axis part 96*c* connecting the first arm part 96*a* and the second arm part 96*b*.

For the sliding operation of the slider body 90 with such a tab tool 96, a user first grips the grip parts of the tab tool 96, brings the both holding parts closer against a spring force of the spring 96*e*, brings the pair of pins 96*d* close to the cover body 92 in the slider body 90, and inserts the pins 96*d* into the left and right windows provided on the cover body 92. Then, the pins 96*d* of the tab tool 96 are fitted inside the body part 94*a* having a substantially U-shape in the stopping pawl part 94*b*, as shown as an imaginary line in FIG. 18.

Subsequently, the user pulls the slider body 90 with the tab tool 96 in a closing or a separating direction of the element rows while holding the grip parts of the tab tool 96. The stopping pawl body 94 is rotated upward with the pins 96*d* of the tab tool 96 against a spring force of the plate spring member 93, and the stopping pawl part 94*b* of the stopping pawl body 94 exits from the element guideway. Therefore, engagement of the stopping pawl part 94*b* in the stopping pawl body 94 with the fastener element of the element rows are released, which enables sliding of the slider body 90 in a closing or a separating direction.

Such a slide fastener as in Patent Document 1 can release an engaging state between the stopping pawl body 94 and the fastener element and slide the slider body 90 easily along the element rows using the tab tool 96. However, the slider body 90 cannot be slid without using the tab tool 96.

Accordingly, in a case that the slide fastener of Patent Document 1 is attached to a cloth for a nursing care receiver, the care receiver wearing the cloth cannot slide the slider body 90 without the tab tool 96, even if he tries to get off the cloth consciously or subconsciously. Therefore, it can be prevented that the care receiver gets off the cloth on his own.

Meanwhile, Japanese Patent Publication No. JP06-209809 (Patent Document 2) discloses using a tool for coupling elements to couple left and right element rows of a slide fastener instead of using a slider.

A tool (jig) for coupling elements described in Patent Document 2 has a pair of first and second arm parts rotatably connected with each other at a pin (supporting point). A pair of holding parts directly holding left and right element rows are disposed on one end part of the first and the second arm parts.

A coupling part for coupling left and right fastener elements is formed on one of the pair of the holding parts. The coupling part has a tapered guide groove which contacts a side edge of a tape inner side of the left and right fastener element rows and guides the left and right element rows in an approaching direction with each other to be coupled, and an engaging pin standing on a center part of one end part in the element row guiding direction in the guide groove.

In a case that left and right element rows without a slider are coupled using such a tool for coupling elements, the element rows and a fastener tape are held with a holding part of the tool for element coupling by holding end parts (coupling starting end parts) of separating left and right element rows at a top and bottom direction of the tape so that the left and right element rows are inserted into the guide groove.

Then, while maintaining the holding state of the element rows and the fastener tape with the holding part, the tool for element coupling is moved to a closing direction of the element rows. The left and right fastener elements are coupled one by one at the coupling part of the holding part, and the slide fastener can be closed.

Using a tool for coupling element as in Patent Document 2 enables coupling of left and right element rows without using a slider. Therefore, a slider can be removed from structural members of a slide fastener. Thus, according to Patent Document 2, a bulkiness due to a slider can be prevented, and a good appearance can be maintained in products in which a fastener is attached.

PRIOR ART DOCUMENTS

Patent Documents

Patent Document 1: Utility Model JP2528168
Patent Document 2: JP 6-209809 A

SUMMARY OF INVENTION

Technical Problem

Slide fasteners are often used for an open and close part of cloths and bags. Recently, they have also been used for a seat cover (surface member) which covers a seat cushion body provided on an automobile.

When a slide fastener attached to such a seat cover is closed by sliding a slider, left and right element rows are approached each other by pulling the slider and drawn into an element guideway of the slider, and fastener elements are coupled. Therefore, when the left and right element rows are coupled in the element guideway of the slider, a large horizontal pulling force pulling to an outside of a fastener tape in a tape width direction, or a pushing up force pulling (or pushing) in a tape top and bottom direction of the fastener tape tend to be applied to the left and right element rows.

In addition to the above, when the slider slides in a closing direction, a large stress tends to be applied to the slider coupling the left and right element rows from the element rows or the fastener tape. In a case the element guideway of the slider has an enough space, a posture of the respective fastener elements constituting the element rows may incline in the element guideway of the slider.

Accordingly, in the conventional slide fastener used to a seat cover, if a slider body of a slider is formed of synthetic resin, the slider body may receive a stress (external force) at the time of coupling the left and right element rows, and an upper blade part and a lower blade part of the slider body may deform in an opening direction each other (particularly, a rear opening side end part of the slider body may deform to open in a top and bottom direction). Further, a flange part of the slider body may deform to bend in an outer direction. Therefore, the slider body of the slider are usually formed of a metal such as zinc because strength can be secured more stably than synthetic resin.

However, a slider body or a tab made of metal is heavier than that made of synthetic resin. Therefore, in an automobile field in which weight-saving and cost-effectiveness are emphasized, it is strongly demanded to reduce weight of the slider and cost of the slide fastener.

A slider body and a tab made of metal may induce an annoying contact noise when the slider body and the tab are not operated but contacted with each other. Particularly, in a case a slide fastener is used as a seat cover of an automobile seat as mentioned above, contact noise sometimes occur because the slider body and the tab are frequently contacted with each other due to automotive vibration, or the slider body and the tab may contact with other members such as a seat frame, which sometimes make passengers annoyed. Therefore, problems to be solved for a slide fastener used for a seat cover include an improvement of quietness.

In order to prevent contact noise of the slider body and the tab and to improve quietness of the slide fastener, it can be considered that as in the slide fastener in Patent Document 1, a slider body 90 without having a tab is attached to element rows, as shown in FIG. 18, and sliding operation of the slider body 90 is performed with a tab tool 96, as shown in FIG. 19.

However, if the slider body 90 shown in FIG. 18, for example, is made of metal, it has a problem to be heavy. On the other hand, if the slider body 90 is made of synthetic resin, appropriate strength required for the slider body 90 at the time of sliding are hardly maintained, and the slider body 90 may deform or break when the slide fastener is closed.

It also can be considered that in order to improve quietness of slide fastener, an element coupling tool as mentioned in Patent Document 2 is used. However, when the left and right element rows are coupled with the element coupling tool as in Patent Document 2, operability of the slider and stability of coupling movement are lower than in a case a slider is used. Accordingly, it has been difficult to adopt the slide fastener of Patent Document 2 to a seat cover which tends to receive large horizontal pulling force or pushing-up force.

Further, a slider is completely removed from the slide fastener using the element coupling tool of Patent Document 2. Therefore, when the slide fastener is completely closed, a horizontal pulling strength or pushing-up strength are hardly secured at a coupling end part in an opening side of the element rows, and when the slide fastener receives a horizontal pulling force and the like, the left and right element rows easily separate from the coupling end part of the opening side of the element rows.

The invention has been accomplished in view of the above conventional problems, and it is a specific object of the invention to provide a slider for a slide fastener in which, even if used to a seat cover for an automobile, when a slider body slides to couple element rows, the slider body is hardly deformed or broken, is lightweight and production-cost saving, and has excellent quietness preventing annoying contact noise.

Solution to Problem

To achieve the above object, the present invention provides a slider for a slide fastener including a synthetic resin slider body which is attached to left and right element rows of a slide fastener and can couple and separate the element rows each other by sliding along the left and right element rows, wherein the slider body includes an upper blade part, a lower blade part disposed parallel to the upper blade part at a predetermined interval, a guide post connecting shoulder opening side end parts of both of the upper and lower blade parts, and a flange part disposed left and right side edge parts of at least one of the upper blade part and the lower blade part, wherein the slider includes a slider handling tool which holds top and bottom sides of the slider body and perform sliding operation to the element rows, the slider handling tool includes a first arm part and a second arm part which cross and connect each other swingably at a crossed point with a connecting axis part, a first grip part and a second grip part disposed at one end part of the first arm part and the second arm part, and a first holding part and a second holding part disposed at the other end part of the first arm part and the second arm part and holding the top and bottom sides of the slider body, the first and second holding parts respectively have a back wall part supporting each back surface of the upper and lower blade parts, and side wall parts which support left and right side surface parts of the upper and lower blade parts are disposed at the first and second holding parts respectively.

In that case, it is preferable that the first holding part has an upper blade part supporting surface which supports a whole upper surface of the upper blade part, and the second holding part has a lower blade part supporting surface which supports a whole lower surface of the lower blade part.

Further, it is particularly preferable that each of the upper surface of the upper blade part and the lower surface of the lower blade part is formed respectively as a single flat surface.

Meanwhile, the slider body may have an engaged concave part or an engaged convex part which is provided on at least one of the upper surface of the upper blade part and the lower surface of the lower blade part. The first holding part may have the upper blade part supporting surface which supports the upper surface of the upper blade part, the second holding part may have the lower blade part supporting surface which supports the lower surface of the lower blade part, and at least one of the first and the second holding parts may further have an engaging convex part or an engaging concave part which engages the engaged concave part or the engaged convex part.

It is also preferable in the present invention that the upper blade part supporting surface of the first holding part has a larger area than the upper surface of the upper blade part, and the lower blade part supporting surface of the second holding part has a larger area than the lower surface of the lower blade part.

In this case, it is preferable that the left and right side wall parts in the first holding part respectively have an enlarged width part which an interval between the left and right side wall parts is gradually increased toward a base end part side of the first holding part, and the left and right side wall parts in the second holding part respectively have an enlarged width part which an interval between the left and right side wall parts is gradually increased toward a base end part side of the second holding part.

Further, at least one of the first and second holding parts preferably has left and right flange regulating part supporting an outside of the flange part of the slider body.

In the slider of the present invention, the first and second holding parts preferably are attached to the first and second arm parts, respectively, in a detachable manner.

In addition, the first and second holding parts preferably have a tapered shape which a dimension in a width direction is gradually decreased toward a tip end part of each holding part.

Subsequently, a main structure of the slider handling tool for sliding operation of the slider body of the present invention is that it includes first and second arm parts which cross and connect each other swingably at the crossed point with a connecting axis part, first and second grip parts disposed at one end part of the respective first and second arm parts and first and second holding parts disposed at the other end part of the first and second arm parts and holding a top and bottom of the slider body, and the slider body is slid while being held with the first and second holding parts.

Advantageous Effect of Invention

The slider of the present invention has a slider body made of synthetic resin in which a tab attaching part allowing a tab to be attached to is removed from an upper blade part and a lower blade part, and a slider handling tool which is independently formed from the slider body and holds a top and a bottom of the slider body in a height direction thereof.

Since the slider of the present invention has a slider body made of synthetic resin and without having a tab, the slider body itself can be lightweight. Further, when the slider is in mass production, there is no need to provide a tab attaching part such as a tab attaching post to each slider body as well as to produce a tab, which results in reduced production cost of the slider. In addition, the slider of the present invention does not make a contact noise between the slider body and the tab, as in the conventional type, and quietness of a slide fastener can be significantly improved.

The slider body of the present invention is made of synthetic resin, and when the slider body is attached to element rows of left and right fastener stringers to slide in a coupling direction of the element rows, the slider body can be slid while being held at a top and a bottom of the slider body with a slider handling tool.

With the above, sliding of the slider body can be performed stably, and even if the slider body receives a stress such as a horizontal pulling force from the element rows at the time of sliding, deformation or breakage of an upper blade part and a lower blade part can be prevented, because the upper and lower blade parts of the slider body are supported with the slider handling tool. Thus, a slide fastener can be smoothly closed.

Particularly, the slider handling tool of the present invention includes first and second arm parts which cross and connect each other swingably at the crossed point with a connecting axis part, first and second grip parts disposed at one end part of the first and second arm parts, and first and second holding parts disposed at the other end of the first and second arm parts and holding a top and bottom of the slider body.

When the slider body is held with such a slider handling tool, the slider body can be easily held with the first and second holding parts of the slider handling tool, and the upper and lower blade parts of the slider body can stably be supported. Therefore, the slider body can be smoothly slid in a coupling direction of element rows while being held with the first and second holding parts, and deformation or breakage of the upper and lower blade parts at the time of sliding the slider body can be more effectively prevented.

In that case, the first holding part of the slider handling tool has an upper blade part supporting surface which supports a whole upper surface of the upper blade part of the slider body, and the second holding part has a lower blade part supporting surface which supports a whole lower surface of the lower blade part of the slider body. Therefore, when the slider body slides, the upper and lower blade parts of the slider body can be supported more stably, which can effectively prevent deformation or breakage of the upper and lower blade parts.

Since each of the upper surface of the upper blade part and the lower surface of the lower blade part in the slider body is formed respectively as a single flat surface, a slider body in which a tab is not needed can be formed in a simple structure, and cost reduction of a slider body can be realized more effectively. As the upper surface of the upper blade part and the lower surface of the lower blade part are formed respectively on a single flat surface, the slider body can be held easily and stably with the upper blade part supporting surface of the first holding part and the lower blade part supporting surface of the second holding part of the slider handling tool. Further, the slider body attached to a slide fastener is hardly got stuck with other members.

Meanwhile, the slider body may have an engaged concave part or an engaged convex part which provided on at least one of the upper surface of the upper blade part or the lower surface of the lower blade part. The first holding part may have the upper blade part supporting surface which supports an upper surface of the upper blade part of the first holding part, the second holding part may have the lower blade part supporting surface which supports a lower surface of the lower blade part, and at least one of the first or the second holding parts may further have the engaging convex part or the engaging concave part which engages the engaged concave part or the engaged convex part.

Since an engaged concave part or an engaged convex part is disposed at the upper blade part or the lower blade part of the slider body, and an engaging convex part or an engaging concave part is disposed at the first and second holding parts of the slider handling tool, when the slider body is held with the slider handling tool, the slider body can be supported by the upper blade part supporting surface of the first holding part and the lower blade part supporting surface of the second holding part, and the engaging convex part or the engaging concave part is engaged to the engaged concave part or the engaged convex part of the slider body to hold the slider body stably at a predetermined position. Thereafter, when the slider body is pulled to slide with the slider handling tool, the engaging convex part or the engaging concave part of the slider handling tool is stuck with the slider body, and the slider body can slide stably.

As the upper blade part supporting surface of the first holding part has a larger area than the upper surface of the upper blade part of the slider body, and the lower blade part of the second holding part has a larger area than the lower surface of the lower blade part supporting surface, the slider body can be held with the upper blade part supporting surface of the first holding part and the lower blade part supporting surface of the second holding part more stably. Particularly, when the slider body is held with the slider handling tool, the slider body can be held easily without accurately adjusting a position of the first and second holding parts and a position of the upper and lower blade parts of the slider body. As a result, operability of the slider handling tool is improved to effectively slide the slider body, and a burden of a user of the slider handling tool can be alleviated.

Further, in the slider handling tool of the present invention, left and right side wall parts which support left and right side surface parts of the upper blade part are disposed on left and right side edge parts of the first holding part, and left and right side wall parts which support left and right side surface parts of the lower blade part are disposed on left and right side edge parts of the second holding part.

With the above, when the slider body is held and slid at a top and bottom thereof with the first and second holding parts, the upper and lower blade parts of the slider body can be also supported at the left and right side edge parts of the first and second holding parts and the slider body is prevented from removing from the first and second holding parts.

Accordingly, the slider body can be slid stably while being held stably by the first and second holding parts.

In this case, the left and right side wall parts in the first holding part have an enlarged width part in a tapered shape which an interval between the left and right side wall parts is gradually increased toward a base end part side of the first holding part, and the left and right side wall parts in the second holding part have an enlarged width part in a tapered shape which an interval between the left and right side wall parts is gradually increased toward a base end part of the second holding part side.

Therefore, when the slider body is held with the first and second holding parts of the slider handling tool, the upper and lower blade parts can be easily introduced between the left and right side wall parts in the first and second holding parts, and the upper surface of the upper blade part and the lower surface of the lower blade part can easily and stably be held with the upper blade part supporting surface and the lower blade part supporting surface disposed between respective left and right side wall parts.

Further, the first holding part of the slider handling tool has a back wall part supporting a back surface of the upper blade part, and the second holding part has a back wall part supporting a back surface of the lower blade part. Thereby the back surfaces of the upper and lower blade parts can be held with the first and second holding parts, and the slider body can stably slide toward a coupling direction of the element rows.

In the present invention, at least one of the first and second holding parts of the slider handling tool has left and right flange regulating parts supporting an outside of the flange part of the slider body. With this, when the slider body is held and slid with the slider handling tool, even if the flange part of the slider body receives a stress from element rows passing through an element guideway, deformation or breakage of the flange part can be effectively prevented, which enables stable closing of the slide fastener.

The first and second holding parts of the slider handling tool of the invention are attached to the first and second arm parts respectively in a detachable manner. Thereby there is no need to prepare slider handling tools fitting slider bodies having various sizes and shape. It can be dealt by preparing plural sets of first and second holding parts fitting each slider body, choose a suitable sets of the first and second holding parts and attach them to the first and second arms. Thereby improvement of operability and cost reduction can be realized.

Further, the first and second holding parts of the slider handling tool in the present invention have a tapered shape in which a dimension in a width direction is gradually decreased toward a tip end part (i.e. toward a separating side of a sliding direction of the slider body). When the slider body is held with the slider handling tool, the first and second holding parts of the slider handling tool can be easily inserted into the slider body attached to the element rows, which makes the slider handling tool easier to use.

Subsequently, the slider handling tool of the present invention includes first and second arm parts which cross and connect each other swingably at the crossed point with a connecting axis part, first and second grip parts disposed respectively at one end part of the first and second arm parts, and first and second holding parts disposed respectively at the other end part of the first and second arm parts. The slider handling tool is formed so as to slide the slider body along element rows while holding a top and a bottom of the slider body with the first and second holding parts.

Using such a slider handling tool of the present invention enables holding the slider body having a structure that a tab cannot be attached with the first and second holding parts, and sliding the slider body easily and stably along the element rows. Once a slider handling tool is produced, it can be used for plural slider bodies. Therefore, the more the slider bodies without a tab are produced, the higher effect of cost reduction in production can be obtained.

DESCRIPTION OF EMBODIMENT

Hereinafter, preferred embodiments of the present invention are described in detail with Examples referring to drawings. It should be noted that the present invention is not limited thereto, and various changes can be made as long as they have a substantially same structure and same functional effects.

For example, explained in the below examples are cases where a slide fastener having a slider of the present invention is attached to a seat cover of an automobile seat as a fastener attached product. However, the slide fastener having the slider of the present invention can be attached to other seat covers or other product other than the seat covers.

Also, the slider as mentioned in the below examples is formed as a slider for a slide fastener formed by plural fastener elements in which element rows continue in a coil like shape. However, the slider of the present invention may be formed as a slider for a slide fastener in which element rows are formed by injection molding of the fastener elements to a fastener tape.

EXAMPLE 1

Figure 1:
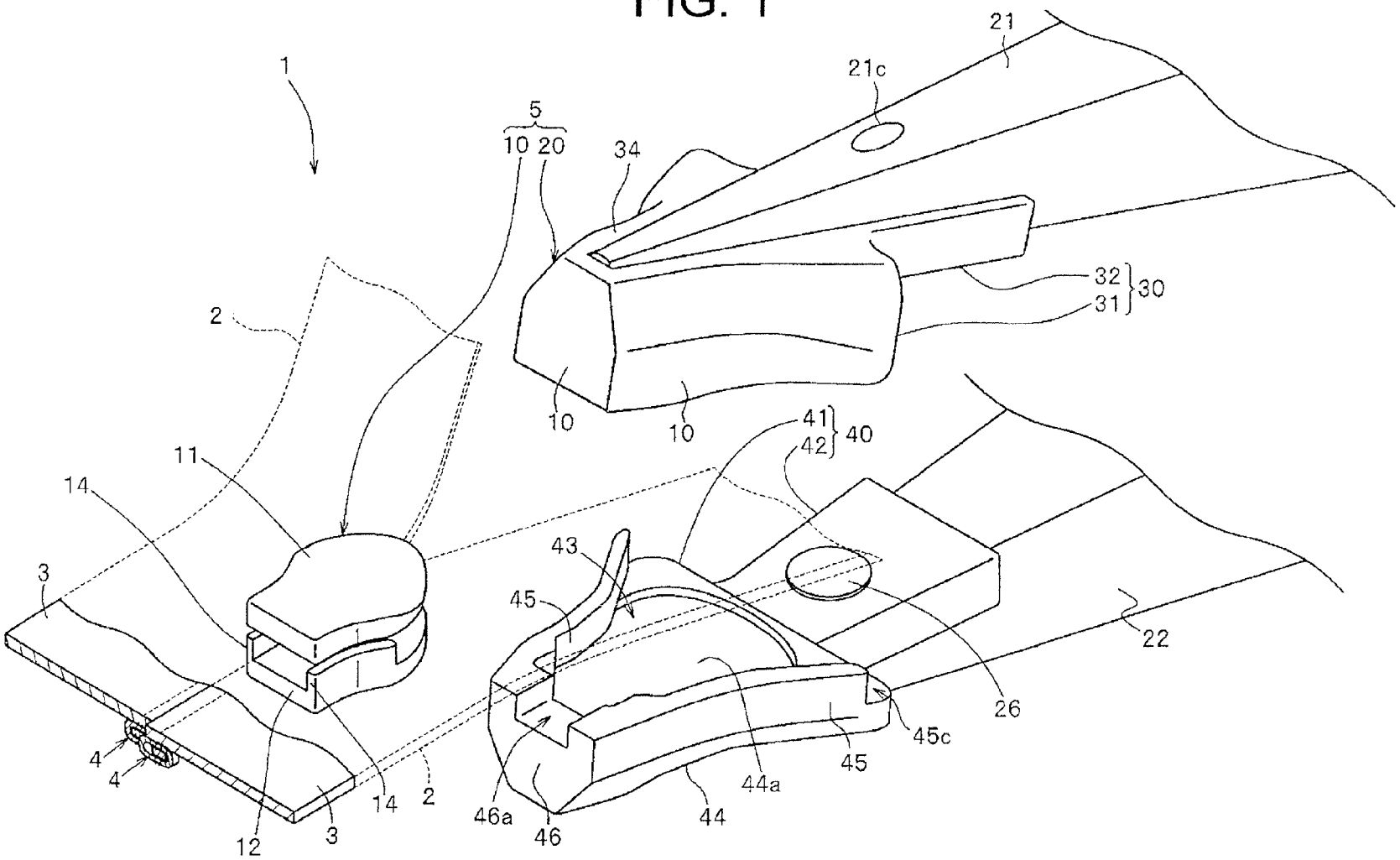
FIG. 1 is a perspective view showing a slide fastener according to Example 1 of the invention.
Figure 2:
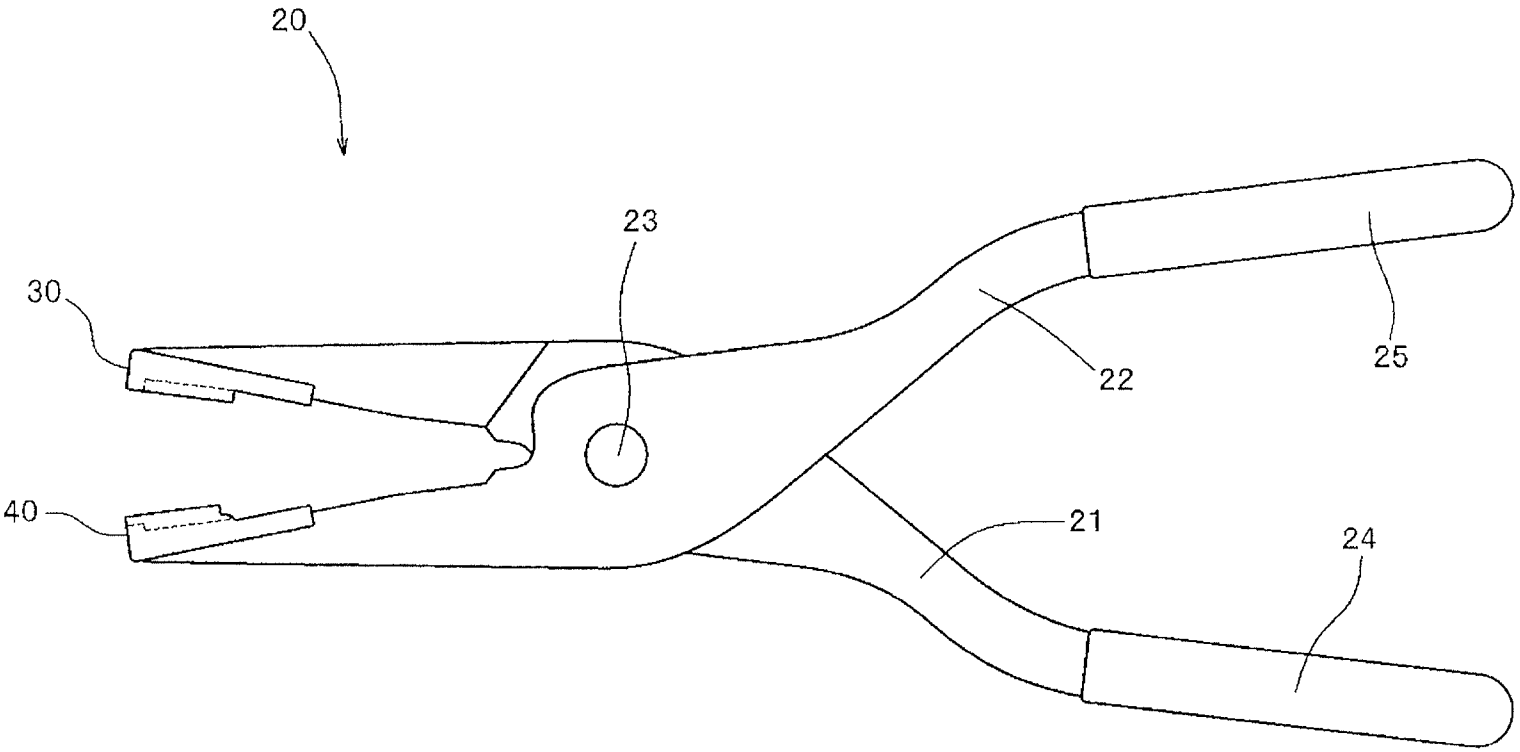
FIG. 2 is an overall view of a slider handling tool of Example 1.
Figure 3:
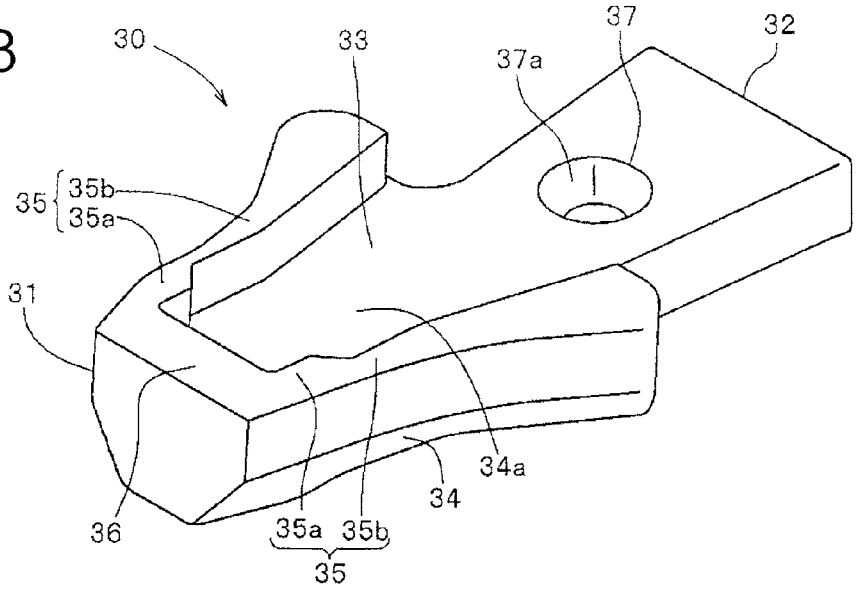
FIG. 3 is a perspective view of a first holding part of the slider handling tool viewing from an inner surface side.
Figure 4:
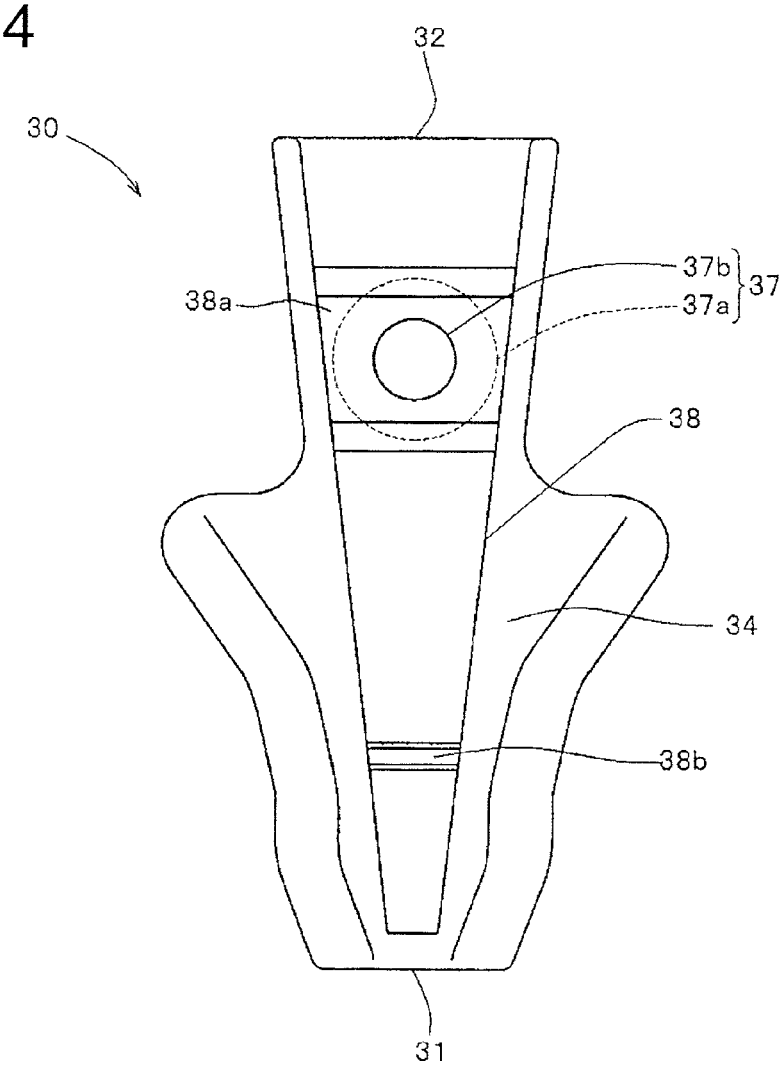
FIG. 4 is a view of the first holding part viewing from an outer surface side.
Figure 5:
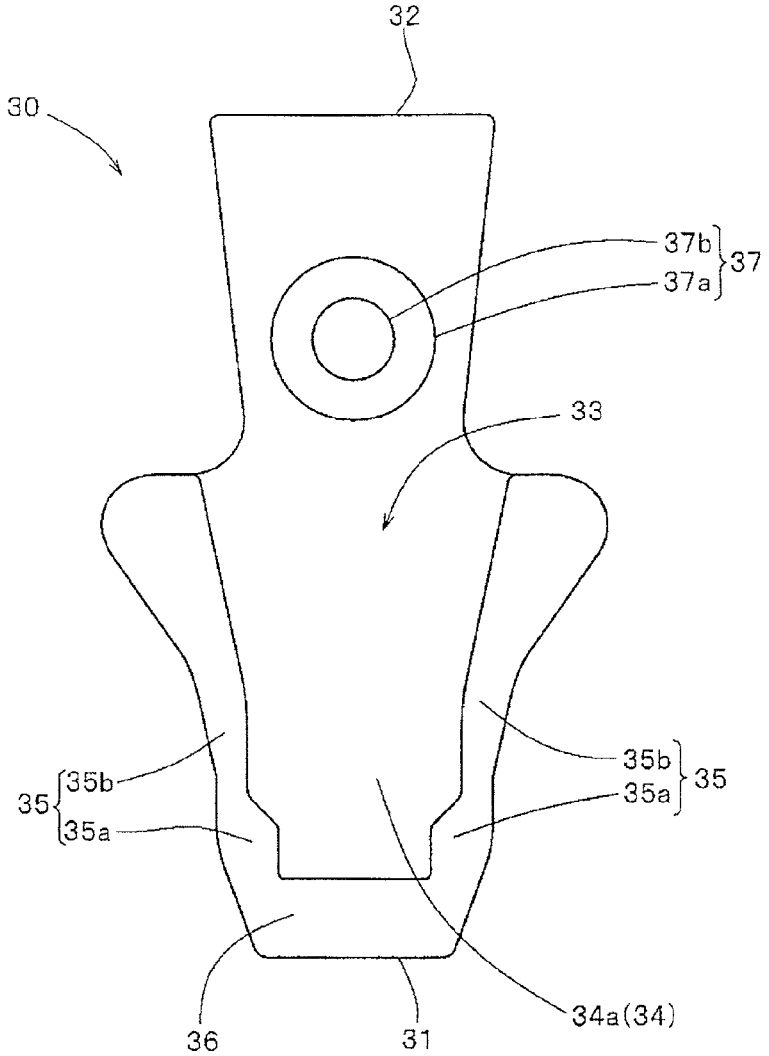
FIG. 5 is a view of the first holding part viewing from an inner surface side.
Figure 6:
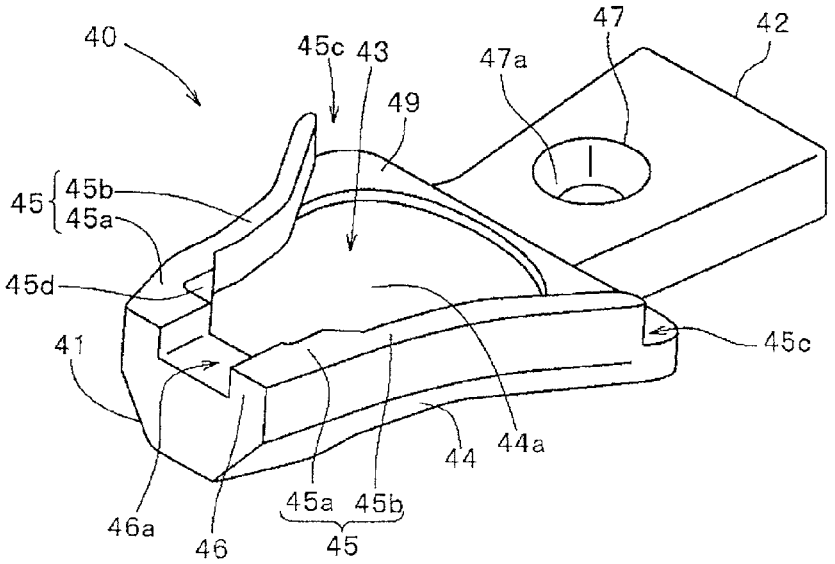
FIG. 6 is a perspective view of a second holding part of the slider handling tool viewing from an inner surface side.
Figure 7:
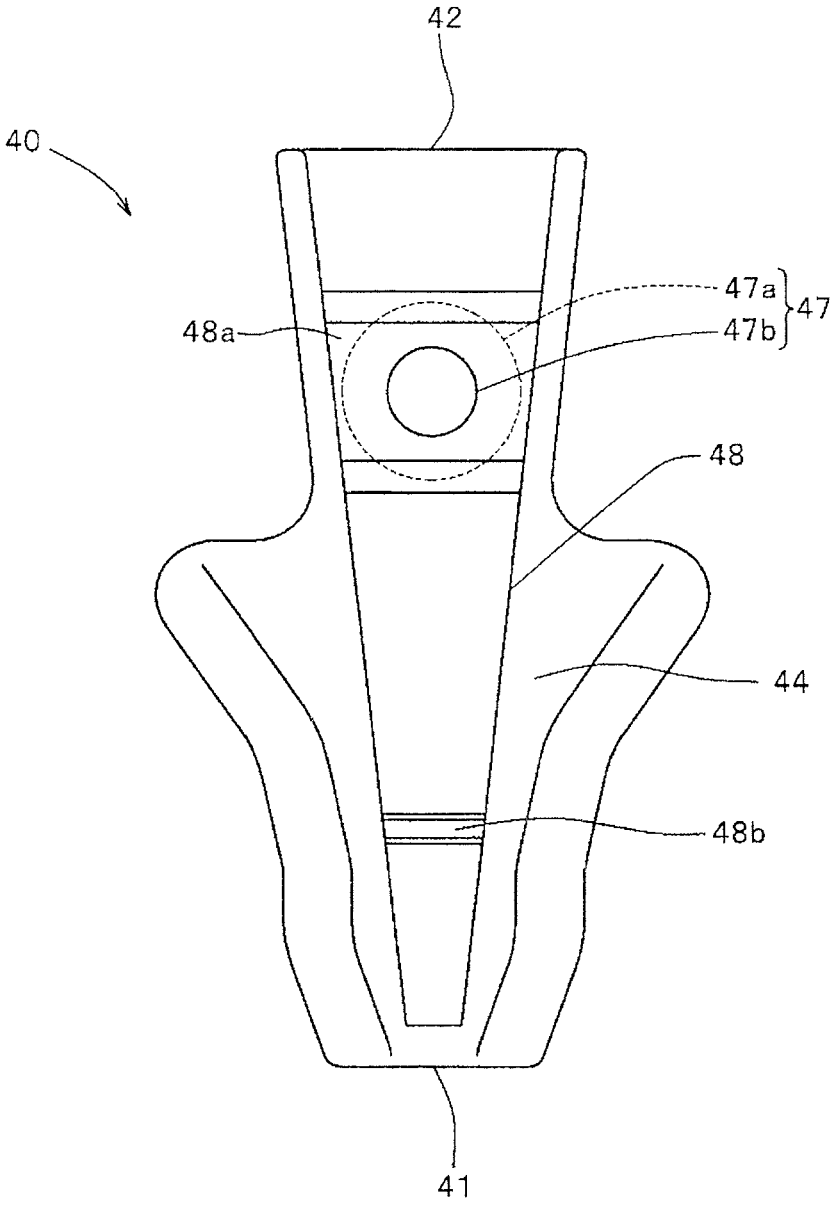
FIG. 7 is a view of the second holding part viewing from an outer surface side.
Figure 8:
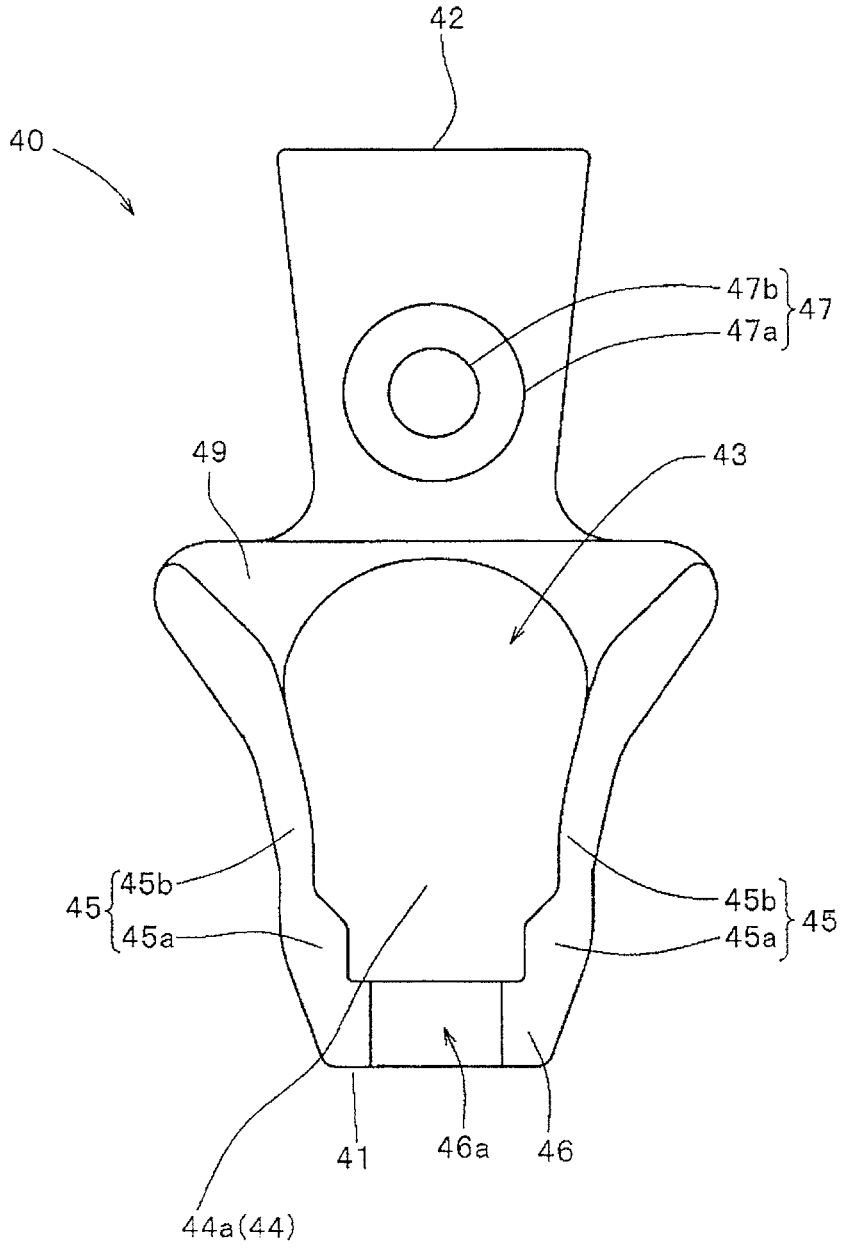
FIG. 8 is a view of the second holding part viewing from an inner surface side.

FIG. 1 shows a perspective view of a slide fastener according to Example 1 of the present invention. FIG. 2 is an overall view of a slider handling tool used for the slide fastener. FIGS. 3 to 5 show a first holding part of the slider handling tool. FIGS. 6 to 8 show a second holding part of the slider handling tool.

In below explanations, front and back direction means a tape length direction of a fastener tape. Particularly, a direction sliding a slider body when left and right element rows are coupled is called "frontward", and a direction sliding the slider when the coupled elements are separated (opened) is called "backward".

Also, left and right direction means a tape width direction of a fastener tape. Top and bottom direction means a tape top and bottom direction of a fastener tape. Specifically, when a slide fastener is attached to a fastener attached member (seat cover), a direction of an outer surface side (or top surface side) of the fastener attached member is called "top" while a direction of an inner surface side (or back surface side) of the fastener attached member is called "bottom".

Slide fastener 1 of the Example 1 in the present invention is a slide fastener used for a seat cover attached to a seat cover of an automobile seat. Specifically, slide fastener 1 is attached linearly on a back surface part which is disposed on a back surface side of a backrest of the seat cover.

The seat cover can be attached to a cushion body by covering the cushion body of a seat with the seat cover in a state slide fastener 1 is open, then sliding a slider body 10, as mentioned later, along element rows 4 in an element coupling direction to close the slide fastener 1.

The slide fastener 1 of Example 1 which is attached to such a seat cover has a pair of left and right fastener stringers 2 in which coil-like element rows 4 are formed along facing tape side edge parts of left and right fastener tapes 3, a first stopping element (upper stopping element) which is not shown, disposed adjacent to the element rows 4 at a front end part of each fastener stringer 2, a second stopping element (lower stopping element), which is not shown, which is disposed adjacent to the element rows 4 at a rear end part of the fastener stringer 2 and bridges the left and right fastener tapes 3, and a slider body 10 slidably disposed along the element rows 4, as shown in FIG. 1. Further, in the slide fastener 1 of Example 1, a slider handling tool 20 for sliding operation of the slider body 10 is prepared as a slider 5 independently from the slider body 10.

A main characteristic of the slide fastener 1 of Example 1 is the slider 5 comprising the slider body 10 and the slider handling tool 20. The fastener stringer 2 and the first and second stopping elements are formed as substantially in a conventional slide fastener.

Specifically, the left and right fastener stringers 2 in Example 1 respectively have a fastener tape 3 woven in a narrow shape and an element row 4 formed on a lower surface (bottom surface) side of the tape at a tape side edge part of the fastener tape 3 facing each other.

That is, the fastener stringer 2 in Example 1 is formed as a fastener stringer 2 for a so-called "reversed coil" slide fastener 1 in which element rows 4 are disposed on an inner surface side of a fastener attached product. Therefore, the slider 5 of Example 1 is formed for a back surface slide fastener 1. It should be noted that the slider of the present invention may be formed for a general "standard coil" slide fastener, as mentioned in Example 3.

The element rows 4 of Example 1 are formed by sewing coil-like continuous fastener elements to the fastener tape 3 by a double circle stitch of a sewing yarn in a state that a core string is passed between upper and lower leg parts, as mentioned below. It should be noted that element rows 4 can also be formed by sewing the fastener elements to the fastener tape 3 without using the core string.

The fastener tape 3 includes a tape main part sewn directly to a fastener attached product such as a cloth and a tape side edge part (element attaching part) which is disposed on one side edge side of the tape main part and fastener elements are sewn to.

The fastener element has a shape continuing like a coil in a tape length direction. A bulged coupling head is formed by pressing a monofilament formed of thermoplastic resin such as polyamide or polyester at predetermined intervals, and the fastener element is formed by rolling the monofilament in a coil-like shape.

Each fastener element has a coupling head with a bulged part which bulges in a front and rear direction (tape length direction), a pair of upper and lower leg parts extending from the coupling head to inside of a tape in the tape width direction, and a connecting part (reversing part) connecting an end part of the upper or lower leg part on a tape inner side to another lower or upper leg part of an adjacent fastener element in a front and rear direction. In this case, the upper leg part of the fastener element is a leg part on a side contacting the fastener tape 3, and the lower leg part is a leg part on a side disposed separately from the fastener tape 3.

The slider 5 of the present invention has a slider body 10 slidably attached to the left and right fastener element rows 4, and a slider handling tool 20 which can hold the slider body 10 for sliding operation, and can prevent the slider body 10 from deformation or breakage. It should be noted that the slider handling tool 20 of Example 1 can also be used for another slider body attached to another slide fastener and having a same shape and dimension as the slider body 10 of Example 1.

The slider body 10 of Example 1 is formed by injection molding of thermoplastic resin such as polyamide, polyacetal, polypropylene or polybutyleneterephthalate, and is lighter than a slider body made of a metal, for example. The slider body 10 includes an upper blade part 11, a lower blade part 12 disposed in parallel to the upper blade part 11 at a predetermined interval, a guide post 13 connecting a shoulder opening side end part (front end part) of the upper blade part 11 and a shoulder opening side end part (front end part) of the lower blade part 12, and a flange part 14 standing on left and right side edge parts of the lower blade part 12, and it has a simple structure to which a tab cannot be attached.

Specifically, an upper surface of the upper blade part 11 and a lower surface of the lower blade part 12 in the slider body 10 are not provided with any convex parts or concave parts, and each of a whole upper surface and a whole lower surface of the slider body 10 is formed as a single flat surface, respectively. That is, the slider body 10 of Example 1 has a shape which does not have a tab attaching post generally disposed on a slider body of a conventional slider either on the upper blade part 11 or the lower blade part 12, and is unable to attach a tab.

Left and right shoulder openings are formed at a front end part of the slider body 10 across a guide post 13, and a rear opening is formed at a rear end of the slider body 10.

A Y-shape element guideway passing through the left and right shoulder openings and one rear opening is formed between the upper and the lower blade parts 11 and 12 of the slider body. Further, a tape running path enabling the fastener tape 3 to run between the flange parts 14 disposed on left and right side parts of the slider body 10 and the lower blade part 12 is formed.

Here, the front end part of the slider body 10 means an area in which a width dimension of the upper or lower blade part is gradually increased rearward from a shoulder opening side tip end (front end) of the slider body 10 in a length direction of the slider body 10, and for example, it means an area from the shoulder opening side tip end of the slider body 10 to a part having a largest width dimension of the upper or lower blade part in the length direction (or sliding direction) of the slider body 10. The left and right side edge parts of the slider body 10 mean left and right end edge parts in an area from a part having a largest width dimension of the upper or lower blade part to the rear opening side end (back end) of the slider body 10.

A slider handling tool 20 of Example 1 is formed like a nipper or a pincer, and has a first arm part 21 and a second arm part 22 crossing each other and made of a metal, a connecting axis part 23 connecting the first arm part 21 and the second arm part 22 at the crossing point, a first grip part 24 disposed at one end part (base end part) of the first arm part 21, a first holding part (upper blade part holding part) 30 fixed to the other end part (tip end part) of the first arm part 21 and supporting the upper blade part 11 of the slider body 10, a second grip part 25 disposed at one end part (base end part) of the second arm part 22 and a second holding part (lower blade part holding part) 40 fixed to the other end part (tip end part) of the second arm part 22 and supporting the lower blade part 12 of the slider body 10. It should be noted that not the nipper-like or the pincer-like shape but other shapes can be employed, as long as it can hold a top and bottom of the slider body.

The first and second arm parts 21 and 22 of Example 1 are formed of a metal. Further, the first and second arm parts 21 and 22 cross in a substantially X-shape, and rotatably connect each other at the crossed point with the connecting axis part. This enables widening or narrowing of a distance between the first and second grips 24 and 25 which are disposed at one end part of the first and second arm parts 21 and 22, to thereby widen or narrow a distance between the first and second holding parts 30 and 40 which are fixed to the other end part of the first and second holding parts 30 and 40.

The first and second grips 24 and 25 are formed by covering one end part of the first and second arm parts 21 and 22 with elastomer so that a user grips the slider handling tool 20 easily, and the slider handling tool 20 is hardly slipped.

Figure 9:
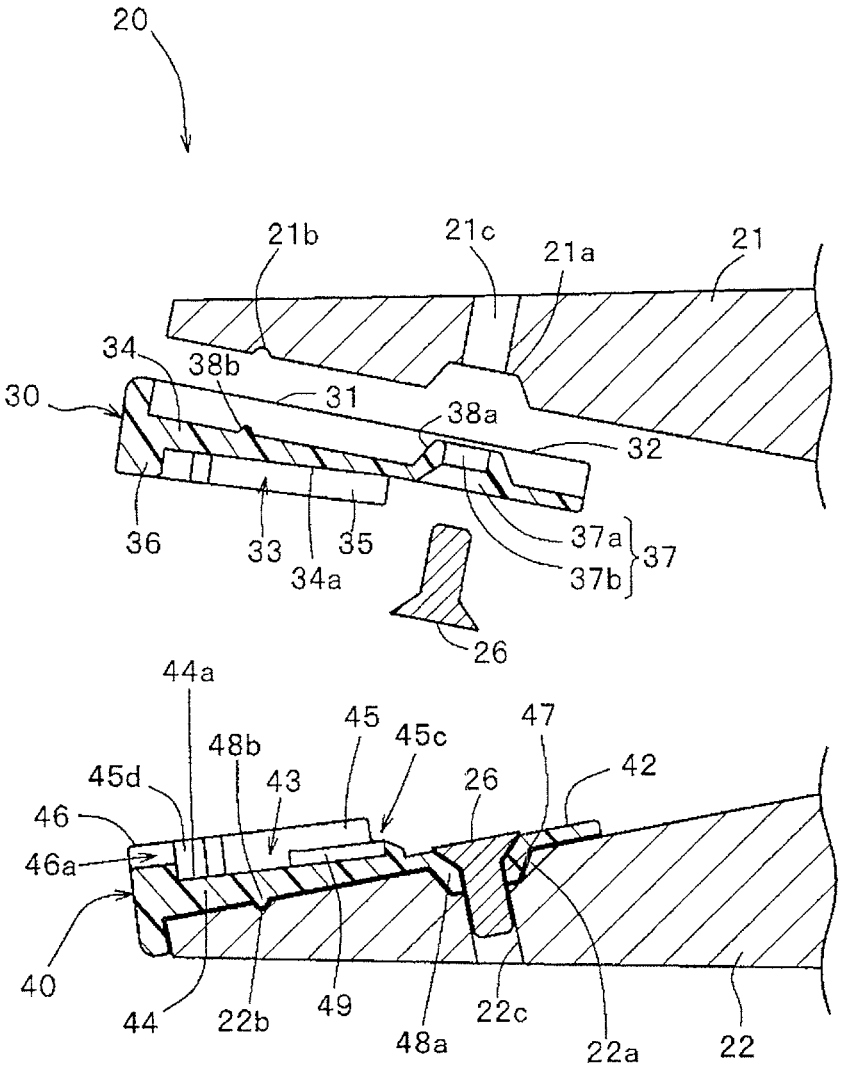
FIG. 9 is an explanatory view explaining attaching of the first and second holding parts to first and second arms of the slider handling tool.

At each tip end part of the first and second arm parts 21 and 22, as shown in FIG. 9, there is provided a first concave part 21*a*, 22*a* provided on an inner surface of the tip end part along a width direction, a screw hole 21*c*, 22*c* which is provided from a groove bottom of the first concave part 21*a*, 22*a* to an outer surface side of a tip end part to screw a bolt 26, as mentioned later, as a fixing member of the first and second holding parts 30 and 40, and the second concave part 21*b*, 22*b* which is provided at an inner surface of a position closer to the tip end part than the first concave part 21*a*, 22*a* of the first and second arm parts 21, 22, in order to fix the first and second holding parts 30 and 40 to the first and second arm parts 21, 22 in an immobilized state.

The first holding part 30 of the slider handling tool 20 is a part made of synthetic resin and housing and supporting the upper blade part 11 of the slider body 10 when the slider body 10 is held with the slider handling tool 20, and it is attached to the first arm part 21 in a detachable manner. It should be noted that the first holding part 30 may be formed of a metal.

The first holding part 30 has, as shown in FIGS. 3-5, a first holding body 31 supporting the upper blade part 11 and a first extended fixing part 32 extending from the first holding body 31 to a side of the connecting axis part 23 along the first arm part 21. The first holding body 31 has a tapered narrow shape in which a dimension of the first holding part 30 in a left and right direction (width dimension) is gradually decreased from a base end part connecting with the first extended fixing part 32 to a tip end part. Further, the first holding body 31 is formed bilaterally symmetrically in a width direction of the first holding part 30 with respect to a center line parallel to a length direction of the first holding part 30.

It should be noted that the length direction of the first holding part 30 means a direction along the first arm part 21. A width direction (left and right direction) of the first holding part 30 means a direction perpendicular to a length direction of the first holding part 30 as well as perpendicular to a rotation direction of the first arm part 21. A thickness direction, as mentioned later, of the first holding part 30 means a direction perpendicular to a length direction and a width direction of the first holding part 30. Same applies to length, width and thickness directions of the second holding part 40 as those of the first holding part 30.

On an inner surface side of the first holding body 31 facing to the second holding part 40, an upper blade part storing concave part 33 (first storing concave part) is provided to store the upper blade part 11. In this case, the first holding body 31 has a bottom surface part 34 of the upper blade part storing concave part 33 having an upper blade part supporting surface 34*a*, a pair of left and right side wall parts 35 disposed at left and right side edge parts of the first holding body 31 and a back wall part 36 disposed at a tip end part of the first holding body 31. The upper blade part storing concave part 33 is surrounded by the bottom surface part 34, the left and right side wall parts 35 and the back wall part 36.

The bottom surface part 34 of the upper blade part storing concave part 33 has a single flat surface (inner surface) having a larger area than a flat upper surface of the upper blade part 11. The flat surface of the bottom surface part 34 is contacted with a whole upper surface of the upper blade part 11 when the slider body 10 is held with the slider handling tool 20, which serves as an upper blade part supporting surface 34*a* which supports the upper blade part 11 from an upper surface side.

In this case, the upper blade part supporting surface 34*a* has a main supporting surface which supports the upper surface of the upper blade part 11 when the upper blade part 11 is contacted with the back wall part 36 of the first holding body 31 and a guide surface disposed between enlarged width parts 35*b*, as mentioned later, of the left and right side wall parts 35 and guides (leads) the upper blade part 11 to the main supporting surface. The main supporting surface is surrounded by the back wall part 36 and the left and right side wall parts 35 of the first holding body 31, and has a shape corresponding to the upper surface of a latter half of the upper blade part 11.

As mentioned above, since the upper blade part supporting surface 34*a* of the upper blade part storing concave part 33 has a larger area than the upper surface of the upper blade part 11, when the slider body 10 is held with the first and second holding parts 30 and 40, as mentioned later, the upper blade part 11 of the slider body 10 can be easily inserted to the upper blade part storing concave part 33 having a larger area and stably supported with the upper blade part supporting surface 34*a*.

Figure 11:
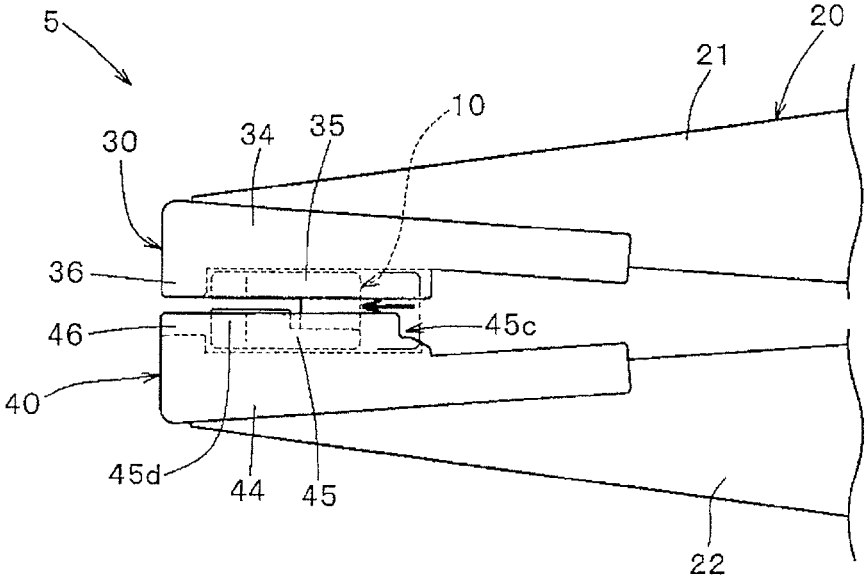
FIG. 11 is an explanatory view explaining a state where the slider body is held with the slider handling tool.
Figure 12:
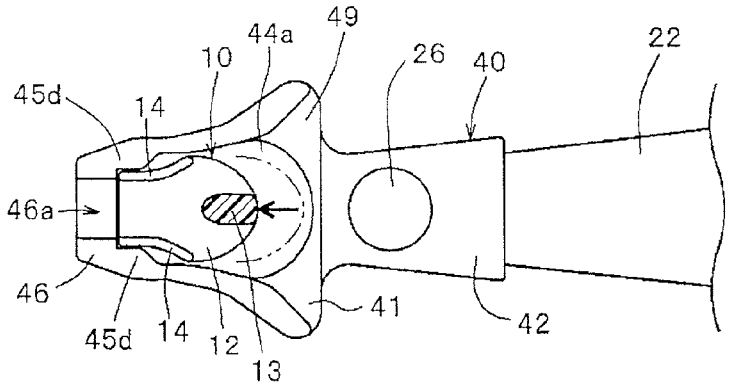
FIG. 12 is an explanatory view explaining a movement of the slider body held with the slider handling tool to a tip end part side.

Further, when the slider body 10 is slid while being held with the first and second holding parts 30 and 40 after the upper blade part 11 is inserted, the upper blade part 11 is slidingly contacted to the upper blade part supporting surface 34*a* to relatively move smoothly to a position that a back end of the upper blade part 11 is contacted to the back wall part 36 of the first holding part 30, and the upper blade part 11 can be supported stably at a position of the above-mentioned main supporting surface of the upper blade part supporting surface 34*a* (see FIGS. 11 and 12).

The left and right side wall parts 35 of the first holding body 31 are formed at the left and right side edge parts of the first holding body 31 to extend in a direction substantially perpendicular to the upper blade part supporting surface 34*a*, and continuously from a tip end of the first holding body 31 to a base end.

The left and right side wall parts 35 have a supporting part 35*a* which is disposed at a tip end part of the first holding body 31 and contacts or approaches left and right side edges of a back end part (rear opening side end part) of the upper blade part 11 when a back end edge of the upper blade part 11 is contacted with the back wall part 36 of the first holding body 31, and an enlarged width part 35*b* which extends from the supporting part 35*a* to a base end part side and gradually increases an interval between the left and right side wall parts 35 (i.e. a width dimension of the upper blade part supporting surface 34*a*) toward the base end part.

The left and right supporting parts 35*a* have an inner wall surface formed according to a shape of left and right side edges of the back end part of the upper blade part 11, and an interval between the left and right supporting parts 35 is determined corresponding to a width dimension of the back end part of the upper blade part 11. The enlarged width part 35*b* has a first enlarged width part which connects the supporting part 35*a* and its inner wall surface is formed as a flat surface inclined with respect to a length direction of the first holding part 30 and a second enlarged width part in which an inner wall surface is formed from the inner wall surface of the first enlarged width part via a curved part and is moderately curved to an outside in a width direction.

The back wall part 36 of the first holding body 31 is formed at a tip end part of the first holding body 31 to extend substantially perpendicular to the upper blade part supporting surface 34*a* and bridges the left and right side wall parts 35 along a width direction of the first holding body 31. Here, an inner wall surface of the back wall part 36 is formed in a flat shape to be a supporting surface which contacts and supports a back end edge (or back end surface) of the upper blade part 11 when the slider body 10 is slid. It should be noted that the first holding body 31 may be formed without the back wall part 36 as long as the left and right side wall parts 35 are provided on the first holding body 31.

The first extended fixing part 32 of the first holding part 30 extends from the first holding body 31 along a length direction of the first holding part 30, and a fixing hole part 37 which allows a bolt (first fixing member) 26 to pass through is provided in the first extended fixing part 32 along a thickness direction of the first holding part 30.

In this case, the fixing hole part 37 is provided on a position corresponding to a position of a screw part 37*b* provided at a tip end part of the first arm part 21. The fixing hole part 37 has a head fitting part 37*a* in which a head of the bolt 26 is fitted and a screw part 37*b* which is formed continuously from the head fitting part 37*a* and an axis part of the bolt 26 is screwed in.

In Example 1, a fitting groove 38 in which a tip end part of the first arm part 21 can be fitted is formed continuously along a length direction of the first holding part 30 on an outer surface of the first holding part 30 (i.e. an outer surface of the first holding body 31 and an outer surface of the first extended fixing part 32).

The fitting groove part 38 has a shape corresponding to a shape of an inner surface side of a tip end part of the first arm part 21. On a groove bottom surface of the fitting groove part 38, first and second ridge parts 38*a*, 38*b* which are inserted and engaged to the first and second concave parts 21*a*, 21*b* provided at a tip end part of the first arm part 21 are provided along a width direction of the first holding part 30.

When such a first holding part 30 is attached to a tip end part of the first arm part 21, a tip end part of the first arm part 21 is fitted in the fitting groove part 38 of the first holding part 30. The first and second ridge parts 38*a*, 38*b* provided on the first holding part 30 are inserted and engaged to the first and second concave parts 21*a*, 21*b* provided at a tip end part of the first arm part 21, and a position of the fixing hole part 37 provided on the first holding part 30 is set on a position of a screw hole part 21*c* provided at a tip end part of the first arm part 21. Then, the fixing bolt 26 is inserted in the fixing hole part 37 of the first holding part 30 and screwed to the fixing hole part 37 and the screw hole part 21*c* of the first arm part 21. Thus, the first holding part 30 is immovably fixed to a tip end part of the first arm part 21 of the first holding part 30.

In Example 1, even after the first holding part 30 is attached to a tip end part of the first arm part 21, the first holding part 30 can be removed from the first arm part 21 by removing screwing of the fixing bolt 26 and pulling out the bolt 26 from the first arm part 21 and the first holding part 30. Further, the first holding part can be replaced by attaching a different first holding part corresponding to other slider bodies having various sizes and shapes to the first arm part 21. It should be noted that in the present invention, a first holding part 30 can be formed on a first arm part 21 integrally by injection molding of thermoplastic resin to a tip end part of the first arm part 21, for example.

The second holding part 40 made of synthetic resin is attached in a detachable manner to a tip end part of the second arm part 22 of the slider handling tool 20 to face the first holding part 30. The second holding part 40 may be formed of a metal, similar to the first holding part 30.

The second holding part 40 has, as shown in FIGS. 6-8, a second holding body 41 supporting the lower blade part 12 and a second extended fixing part 42 extending from the second holding body 41 to a side of the connecting axis part 23 along the second arm part 22. The second holding body 41 has a tapered narrow shape in which a width dimension of the second holding part 40 is gradually decreased from a base end part to a tip end part, and is formed bilaterally symmetrically in a width direction of the second holding part 40, similar to the first holding body 31.

On an inner surface side of the second holding body 41 facing to the first holding part 30, a lower blade part storing concave part (second storing concave part) 43 which can store the lower blade part 12 is provided. In this case, the second holding body 41 has a bottom surface part 44 of the lower blade part storing concave part 43 having a lower blade part supporting surface 44*a*, a pair of left and right side wall parts 45 disposed at left and right side edge parts of the second holding body 41, a pair of left and right flange regulating parts 45*d* protruding integrally from the left and right side wall parts 45 and supporting an outside of the left and right flange parts 14 of the slider body 10, a back wall part 46 disposed on a tip end part of the second holding body 41 and a raised part 49 disposed at a base end part of the second holding body 41. The lower blade part storing concave part 43 is surrounded by the bottom surface part 44, the left and right side wall parts 45, the back wall part 46 and the raised part 49.

The bottom surface part 44 of the lower blade part storing concave part 43 has a single flat surface (inner surface) having a larger area than a flat upper surface of the lower blade part 12. The flat surface of the bottom surface part 44 is contacted with a whole lower surface of the lower blade part 12 when the slider body 10 is held with the slider handling tool 20, which serves as a lower blade part supporting surface 44*a* which supports the lower blade part 12 from a lower surface side.

In this case, the lower blade part supporting surface 44*a* has a main supporting surface which supports the lower surface of the lower blade part 12 when the lower blade part 12 is contacted with the back wall part 46 of the second holding body 41 and a guide surface which is surrounded by an enlarged width part 45*b*, as mentioned later, of the left and right side wall parts 45 and the raised part 49, and guides (leads) the lower blade part 12 to the main supporting surface. The main supporting surface is surrounded by the back wall part 46 of the second holding body 41 and the left and right side wall parts 45, and has a shape corresponding to an upper surface of a latter half of the lower blade part 12.

As mentioned above, since the lower blade part supporting surface 44*a* of the lower blade part storing concave part 43 has a larger area than the lower surface of the lower blade part 12, the lower blade part 12 of the slider body 10 can stably be supported by the lower blade part supporting surface 44*a*, similar to a case of the upper blade part supporting surface 34*a* of the upper blade part storing concave part 33. Further, when the slider body 10 is slid while being held with the first and second holding parts 30 and 40, the lower blade part 12 is moved while slidingly contacting the lower blade part supporting surface 44*a*, and can be supported at a position of the main supporting surface of the lower blade part supporting surface 44*a*, as mentioned above.

The left and right side wall parts 45 of the second holding body 41 are formed at the left and right side edge parts of the second holding body 41 to extend in a direction substantially perpendicular to the lower blade part supporting surface 44*a*, and continuously from a tip end of the second holding body 41 to a base end.

The left and right side wall parts 45 also has a supporting part 45*a* disposed at a tip end part of the second holding body 41, and an enlarged width part 45*b* extending from the supporting part 45*a* to a base end part side and gradually increase an interval between the left and right side wall parts 45, similar to the first holding body 31. The left and right supporting parts 45*a* have an inner wall surface formed according to a shape of left and right side edges of a back end part of the lower blade part 12, and an interval between the left and right supporting parts 45 is determined corresponding to a width dimension of the back end part of the lower blade part 12.

The enlarged width part 45*b* has a first enlarged width part formed as a flat surface and a second enlarged width part formed from an inner wall surface of the first enlarged width part via a curved part to moderately curve. Further, in an end part on a side of a base end part in the left and right side edge parts (end part of the second enlarged width part), an introducing part 45*c* having a notch shape to introduce the element rows 4 of the left and right fastener stringers 2.

The respective left and right flange regulating parts 45*d* are formed on an upper end of the side wall part 45 integrally in a same width dimension as the side wall part 45. That is, the flange regulating part 45*d* can be restate as a part (upper end part) of the side wall part 45 which can support an outside of the left and right flange parts 14 of the slider body 10. Therefore, the flange regulating part 45*d* has a supporting part disposed on a tip end part and an enlarged width part extending from the supporting part, as in the side wall part 45.

The back wall part 46 of the second holding body 41 is formed at a tip end part of the second holding body 41 to extend substantially perpendicular to the lower blade part supporting surface 44*a* and bridge the left and right side wall parts 45 along a width direction of the second holding body 41. An insertion hole part 46*a* which allows the coupled left and right element rows 4 to pass through when the slider body 10 is held with the first and second holding parts 30, 40 is formed on an upper end part (tip end part) of the back wall part 46. It should be noted that the second holding body 41 may be formed without the back wall part 46 as long as the left and right side wall parts 45 are provided on the second holding body 41.

The raised part 49 of the second holding body 41 is disposed on a base end part of the second holding body 41 between the left and right side wall parts 45. An inner wall surface of the raised part 49 is formed as a curved surface to be a semicircular shape when viewed from a side of the first holding part 30, and constitutes a wall surface on a side of a base end part of the lower blade part storing concave part 43.

In this case, a height dimension of the raised part 49 from the bottom surface part 44 (lower blade part supporting surface 44*a*) is smaller than a height dimension of the left and right side wall parts 45 from the bottom surface part 44 (lower blade part supporting surface 44*a*). Due to the height difference between the raised part 49 and the side wall part 45, a gap for the element rows 4 of the fastener stringers 2 passing through can be secured on an inner surface side of the raised part 49 when the slider body 10 is held with the first and second holding parts 30, 40.

The second extended fixing part 42 of the second holding part 40 extends from the second holding body 41 along a length direction of the second holding part 40, and a fixing hole part 47 which enables a bolt (second fixing member) 26 passing through is provided on a position corresponding to a position of a screw hole part 21*c* provided at a tip end part of the first arm part 21 along a thickness direction of the second holding part 40. The fixing hole part 47 has a head fitting part 47*a* in which a head of the bolt 26 is fitted and a screw part 47*b* which is formed continuously from the head fitting part 47*a* and an axis part of the bolt 26 is screwed in.

Similar to the first holding part 30, a fitting groove part 48 in which a tip end part of the second arm part 22 can be fitted is formed continuously along a length direction of the second holding part 40 on an outer surface of the second holding part 40 (i.e. an outer surface of the second holding body 41 and an outer surface of the second extended fixing part 42). On a groove bottom surface of the fitting groove part 48, first and second ridge parts 48*a*, 48*b* which are engaged to the first and second concave parts 22*a*, 22*b* provided at a tip end part of the second arm part 22 are provided along a width direction of the second holding part 40.

The second holding part 40 is immovably fixed to a tip end part of the second arm part 22 using the fixing bolt 26. Further, the second holding part can be replaced by removing screwing of the fixing bolt 26 at a tip end part of the second arm part 22. Please also note that in the present invention, a second holding part 40 can be formed on a second arm part 22 integrally by injection molding of thermoplastic resin to a tip end part of the second arm part 22.

Subsequently, a method of sliding operation of the slider body 10 using the slider handling tool 20 along the element rows 4 in a closing direction of the slide fastener 1 of Example 1 is described as below.

In Example 1, an operator covers a cushion body of a seat with a seat cover in a state that the slide fastener 1 attached to the seat cover is open, and slides the slider body 10 of the slide fastener 1 in a coupling direction along the element rows 4 to close the slide fastener 1.

The operator first grips the first and second grip parts 24 and 25 of the slider handling tool 20, and inserts the first and second holding parts 30 and 40 to the slider body 10 from an open side of the slide fastener 1 (a side at which left and right element rows 4 are separated) in a state that the first and second holding parts 30 and 40 are separated from each other (a state that the first and second arms are open), as shown in FIG. 1.

Figure 10:
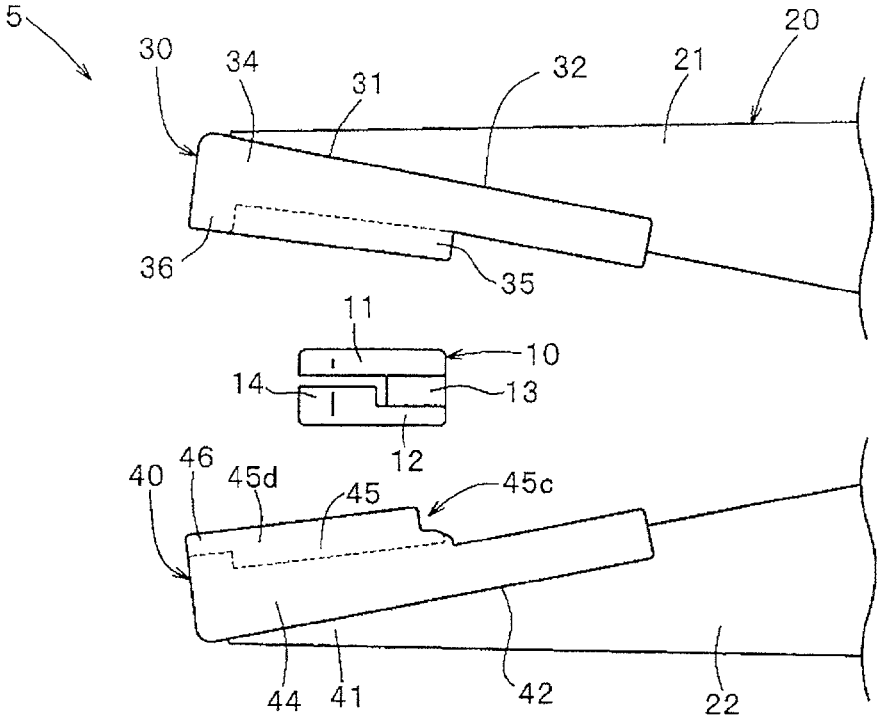
FIG. 10 is an explanatory view explaining position relationship when a slider body is held with the slider handling tool.

Then, as shown in FIG. 10, he sets a position of the first and second holding parts 30 and 40 at a position of the slider body 10. In FIG. 10, fastener stringer 2 is not shown in order to clearly show a relative position of the slider handling tool 20 and the slider body 10.

At this time, the first and second holding parts 30 and 40 of the slider handling tool 20 have a tapered narrow shape in which a width dimension is decreased to a tip end, as mentioned above, thereby when the first and second holding parts 30 and 40 are inserted to the slider body 10, the first and second holding parts 30 and 40 are hardly stuck with the slide fastener 1 or other members, which results in smooth inserting operation of the first and second holding parts 30 and 40.

After inserting the first and second holding parts 30 and 40 of the slider handling tool 20 into a position of the slider body 10, he further grips and closes the first and second grip parts 24 and 25 to make them closer. As the above, he makes the first and second holding parts 30 and 40 closer to each other, and inserts the upper blade part 11 of the slider body 10 into the upper blade part storing concave part 33 of the first holding part 30 and the lower blade part 12 of the slider body 10 into the lower blade part storing concave part 43 of the second holding part 40 to hold the slider body 10 between the first and second holding parts 30 and 40, as shown in FIG. 11.

In Example 1, each of the upper blade part supporting surface 34*a* of the first holding part 30 and the lower blade part supporting surface 44*a* of the second holding part 40 has a larger area than each of the flat upper surface of the upper blade part 11 and the flat lower surface of the lower blade part 12 of the slider body 10, as mentioned above.

In addition, in the slider handling tool 20 of Example 1, the left and right side wall parts 35 and 45 of the first and second holding parts 30 and 40 are disposed to incline so that a width dimension of each of the upper blade part supporting surface 34*a* and the lower blade part supporting surface 44*a* spread largely toward a base end side of each of the first and second holding parts 30 and 40. Therefore, the first and second holding parts 30 and 40 are formed to easily introduce the slider body 10 to a base end part side of the upper blade part storing concave part 33 and the lower blade part storing concave part 43.

Accordingly, when the slider body 10 is held between the first and second holding parts 30 and 40, the positions of the first and second holding parts 30 and 40 may be adjusted roughly to the position of the slider body 10 to a degree that the slider body 10 is inserted into the upper blade part storing concave part 33 of the first holding part 30 and the lower blade part storing concave part 43 of the second holding part 40, and it is not needed to accurately adjust the position of the slider body 10 to contact the back wall parts 36 and 46 at a tip end part of the first and second holding parts 30 and 40. Therefore, the operator can easily and promptly hold the slider body with the first and second holding parts 30 and 40 of the slider handling tool 20, which reduces operating burden and improves operating efficiency.

By holding the slider body 10 with the first and second holding parts 30 and 40, a whole flat upper surface of the upper blade part 11 of the slider body 10 can contact and support the flat upper blade part supporting surface 34*a* of the first holding part 30, and a whole flat lower surface of the lower blade part 12 of the slider body 10 can contact and support the flat lower blade part supporting surface 44*a* of the second holding part 40.

Subsequently, while holding the slider body 10 with the first and second holding parts 30 and 40, he moves the slider handling tool 20 to move the first and second holding parts 30 and 40 in a closing direction of the slide fastener 1 along the element rows 4. In a case that the slider body 10 is not contacted with the back wall part 36 of the first holding part 30 and the back wall part 46 of the second holding part 40, for example, he can move the first and second holding parts 30 and 40 relatively with respect to the stopped slider body 10. That means, he can move the slider body 10 relatively to a tip end part side of the first and second holding parts 30 and 40 (a side of the back wall part 36 and 46 of the first and second holding parts 30 and 40).

Since the left and right side wall parts 35 and 45 are respectively provided on the first and second holding parts 30 and 40, the upper blade part 11 and the lower blade part 12 of the slider body 10 are guided by the above-mentioned left and right side wall parts 35 and 45, and as shown in FIGS. 11 and 12, the upper blade part 11 and the lower blade part 12 are moved while slidingly contacting the upper blade part supporting surface 34*a* of the first holding part 30 and the lower blade part supporting surface 44*a* of the second holding part 40, respectively. Thereby a whole back end edge (back surface) of the upper blade part 11 and a whole back end edge (back surface) of the lower blade part 12 can be contacted with the back wall part 36 of the first holding part 30 and the back wall part 46 of the second holding part 40, respectively.

In Example 1, it is preferable that the whole back end edge of the upper blade part 11 and the whole back end edge of the lower blade part 12 are contacted with the back wall part 36 of the first holding part 30 and the back wall part 46 of the second holding part 40, respectively. However, the upper blade part 11 and the lower blade part 12 do not have to completely contact the back wall part 36 of the first holding part 30 and the back wall part 46 of the second holding part 40, respectively, as long as the positions of the upper blade part 11 and the lower blade part 12 are moved to close to a tip end part of the first and second holding parts 30 and 40.

Further, in Example 1, as the upper blade part 11 and the lower blade part 12 move until they contact with the back wall part 36 of the first holding part 30 and the back wall part 46 of the second holding part 40, respectively, left and right side edges (or left and right side surfaces) of a latter half part of the upper blade part 11 can be contacted with the left and right side wall parts 35 of the first holding part 30, and left and right side edges (or left and right side surfaces) of a latter half part of the lower blade part 12 can be contacted with the left and right side wall parts 45 of the second holding part 40.

With the above, the slider body 10 can be maintained stably at a predetermined position on a tip end part of the first and second holding parts 30 and 40, and the whole upper surface of the upper blade part 11 and the whole lower surface of the lower blade part 12 can be supported unfailingly with the upper blade part supporting surface 34*a* of the first holding part 30 and the lower blade part supporting surface 44*a* of the second holding part 40.

Further in Example 1, when the lower blade part 12 of the slider body 10 is contacted with the back wall part 46 of the second holding part 40, the left and right flange parts 14 provided on the lower blade part 12 are contacted with the left and right flange regulating parts 45*d* of the second holding part 40 and supported from an outside by the flange regulating parts 45*d*.

Then, while the upper blade part 11, the lower blade part 12 and the left and right flange parts 14 of the slider body 10 are supported by the first and second holding parts 30 and 40, as mentioned above, the operator pulls the slider handling tool 20 to move the first and second holding parts 30 and 40 in a closing direction of the slide fastener 1 along the element rows 4.

The slider body 10 is thereby pulled by receiving forces from the back wall parts 36 and 46 and the left and right side wall parts 35 and 45 of the first and second holding parts 30 and 40 in the slider handling tool 20, and the slider body 10 without having a tab can be slid smoothly and stably in a closing direction along the element rows 4.

Particularly in Example 1, when the slider body 10 made of synthetic resin is slid, as mentioned above, a whole upper surface of the upper blade part 11 and a whole lower surface of the lower blade part 12 of the slider body 10 contact the upper blade part supporting surface 34*a* of the first holding part 30 and the lower blade part supporting surface 44*a* of the second holding part 40 in the slider handling tool 20, respectively and are supported in a top and bottom direction by these upper blade part supporting surface 34*a* and the lower blade part supporting surface 44*a*.

Therefore, even if the upper blade part 11 and the lower blade part 12 of the slider body 10 receive a horizontal pulling force or a pushing up force from the element rows 4 and the fastener tape 3 passing through the element guideway at when the slider body 10 slides, and an external force in a top and bottom direction is applied to spread an interval between the upper and lower blade parts 11 and 12, supporting the upper blade part 11 and the lower blade part 12 by the first and second holding parts 30 and 40 can effectively prevent deformation or breakage such as a crack of the upper and lower blade parts 11 and 12.

When the slider body 10 slides, the left and right flange parts 14 are supported from an outside by the left and right flange regulating parts 45*d* of the slider handling tool 20. Therefore, even if the left and right flange parts 14 of the slider body 10 receive an external force such as a horizontal pulling force from the element rows 4 or the fastener tape 3 passing through the element guideway, deformation or breakage of the left and right flange parts 14 by the external force can be effectively prevented.

Thereafter, the slide fastener 1 can be completely closed by sliding the slider body 10 until the slider body 10 contacts a first stopping element of the slide fastener 1 to couple left and right element rows entirely.

Further, when the slide fastener 1 is closed, the slider body 10 is maintained at an end part of the left and right element rows 4. Therefore, a horizontal pulling strength and a pushing up strength at a coupling end part of the element rows 4 can be more appropriately secured than a case of a slide fastener in which a slider body is not used, as mentioned in Patent Document 2.

When opening the closed slide fastener 1 as mentioned above, the slider body 10 can be easily slid in a separating direction using not the slider handling tool 20 but fingers to thereby separating the left and right element rows 4 serially. In this case, the slide fastener 1 can also be opened by holding the slider body 10 with the slider handling tool 20 to slide in a separating direction of the slide fastener 1.

After the slide fastener 1 in Example 1 is closed, a lower end part of a back surface part of a seat cover is bent inward and inserted between the seat cover and a cushion body to bury the slider body 10 not to be appeared outside. Thereby an automobile seat which the cushion body is covered by the seat cover can be produced.

As explained above, the slider body 10 of Example 1 is made of synthetic resin, and it is lighter than a slider body made of metal.

Further, the slider body 10 of Example 1 does not have a tab which is generally disposed in a conventional slider or a tab attaching part with which the tab is attached to the slider body. Therefore, the slider body 10 of Example 1 can be formed in a simple shape, and the slider body 10 can be produced efficiently and at a low cost in a mass production of the slide fastener 1. Further, as the slide fastener does not have a tab, a contact noise of the slider body 10 and the tab does not occur, which enables a production of the slide fastener 1 which is greatly excellent in quietness.

In this way, the slide fastener 1 of Example 1 is lightweight and excellent in quietness, and is particularly suitable to fastener attached products in an automobile field such as a seat cover for an automobile seat.

Even if the slide fastener 1 receives a large horizontal pulling force or a pushing up force at the time of closing, deformation or breakage of the slider body 10 made of synthetic resin such that the back end part of the upper or lower blade parts 11 and 12 opens, or deformation or breakage of the flange part 14 can be effectively prevented by using the above mentioned slider handling tool 20, and the slider body 10 can be smoothly slid to couple the left and right element rows 4 stably.

Further, in Example 1, sliding operation of respective slider bodies 10 disposed at plural slide fasteners 1 can be performed using one slider handling tool 20. Therefore, when fastener attached products are mass produced, production cost for one slider body 10 can be reduced, which results in cost reduction in the fastener attached products.

Regarding the slider handling tool 20 of Example 1, fitting groove parts 38 and 48 having a shape corresponding to the first and second arm parts 21 and 22 are provided at the first and second holding parts 30 and 40, respectively. The first and second holding parts 30 and 40 are immovably fixed using the fixing bolt 26 at tip end parts of the first and second arm parts 21 and 22 in a state that the first and second arm parts 21 and 22 are fitted in the fitting groove parts 38 and 48, respectively. Thereby, when the slider body 10 is held and slid with the slider handling tool 20, the slider body 10 can be held easily, an angle of the slider body 10 with respect to the slider handling tool 20 can be stabilized, and the slider body 10 can be smoothly slid along the element rows 4 with the slider handling tool 20.

Figure 13:
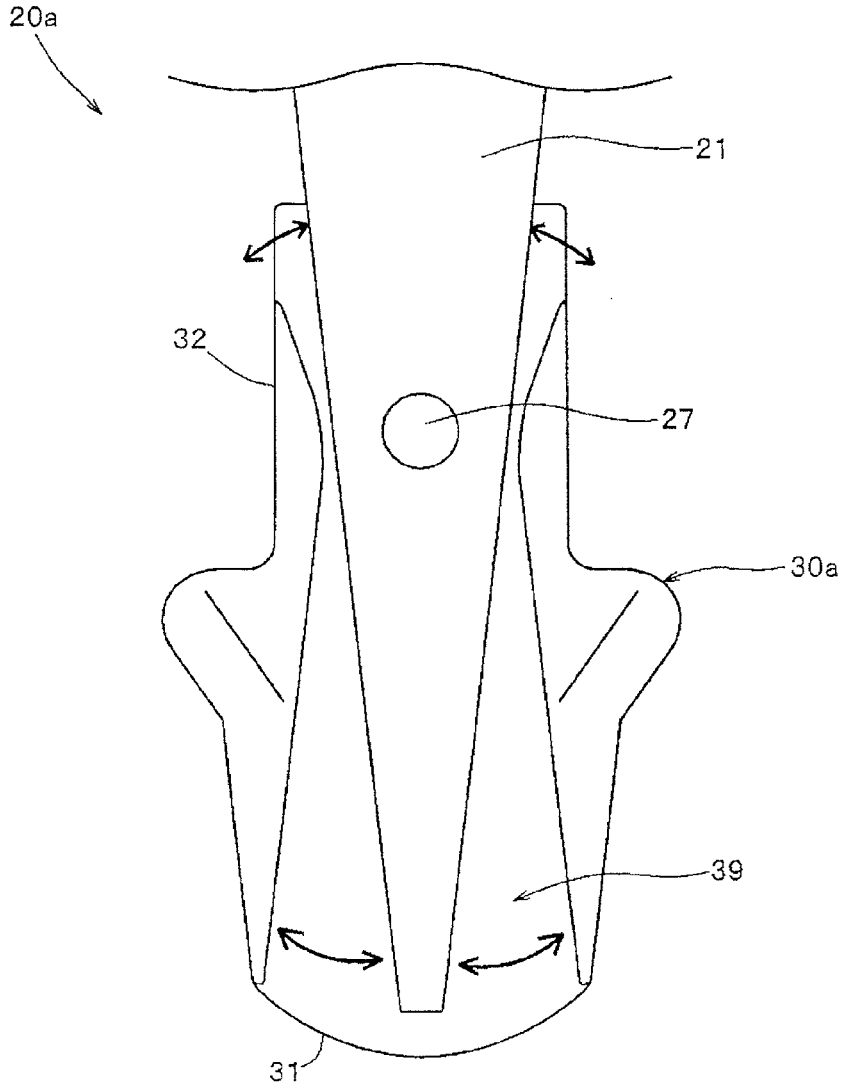
FIG. 13 is an enlarged view showing main parts of the slider handling tool according to a deformed example of Example 1.

Further, as FIG. 13 shows a major part of a modification example of the slider handling tool 20*a*, for example, it is possible that a fitting groove part 39 provided on the first holding part 30*a* and the fitting groove part provided on the second holding part which is not shown are formed larger in a width direction than respective tip end parts of the first arm part 21 and the second arm part 22, and the first holding part 30*a* and the second holding part is fixed swingably or rotatably parallel to the upper surface of the upper blade part and the lower surface of the lower blade part of the slider body at respective tip end parts of the first arm part 21 and the second arm part 22 using a fixing member 27 such as a pin.

In this case, a first ridge part or a second ridge part are not provided on a groove bottom surface of the fitting groove part 39 of the first holding part 30*a* and the second holding part, as in the above mentioned Example 1, and the groove bottom surface is formed as a flat surface. It should be noted that the first holding part 30*a* and the second holding part regarding the modification example are formed as same as the first holding part 30 and the second holding part 40 of Example 1 except the above.

By using the fastener handling tool 20 in which the first holding part 30*a* and the second holding part are pivotably supported swingably or rotatably at respective tip end parts of the first arm part 21 and the second arm part, the slider body 10 can be smoothly slid in such a case that the element rows 4 of the slide fastener 1 are disposed not linearly as in Example 1 but in a curved manner left-hand side or right-hand side on a seat cover as a fastener attached product.

That is, by moving the slider handling tool 20*a* shown in FIG. 13 along the element rows 4 disposed in a curved manner while holding the slider body 10, and the slider body can be smoothly slid along the element rows 4 while changing an angle of the first holding part 30*a* and the second holding part and an angle of the slider body 10 held with the first holding part 30*a* and the second holding part with respect to the first arm part 21 and the second arm part in accordance with an inclination (curved shape) of the element rows 4 smoothly, which does not need to slightly change an angle of the slider handling tool 20*a*. Thereby the left and right element rows 4 disposed in a curved manner can be smoothly coupled, and the slide fastener 1 can be easily closed, which improves an operability of the slider handling tool 20*a*.

EXAMPLE 2

Figure 14:
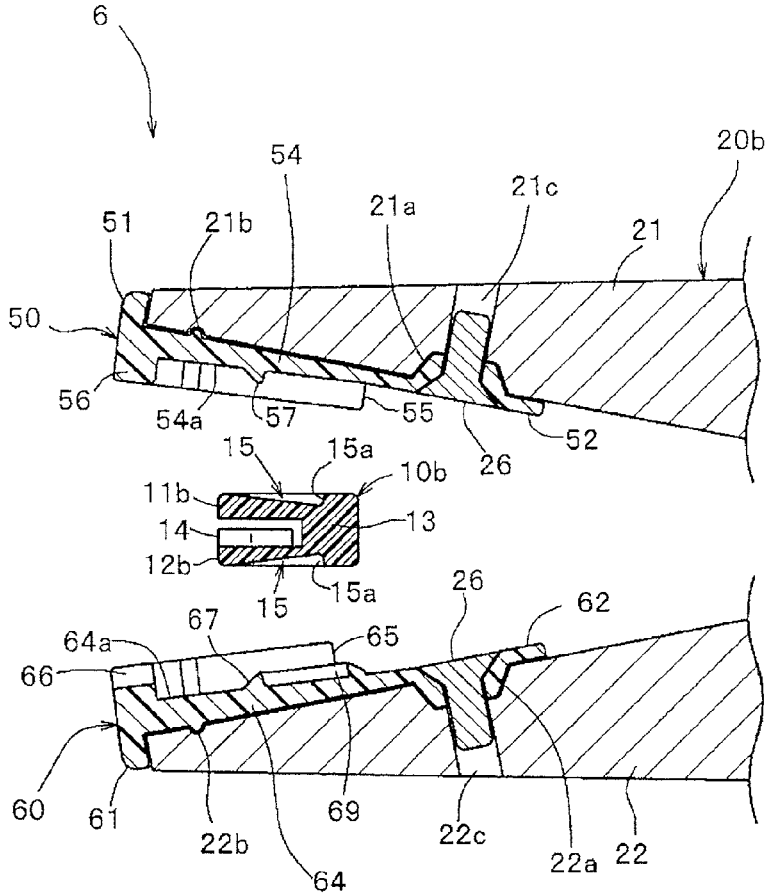
FIG. 14 is a cross-sectional view of the slider body and the slider handling tool according to Example 2.
Figure 15:
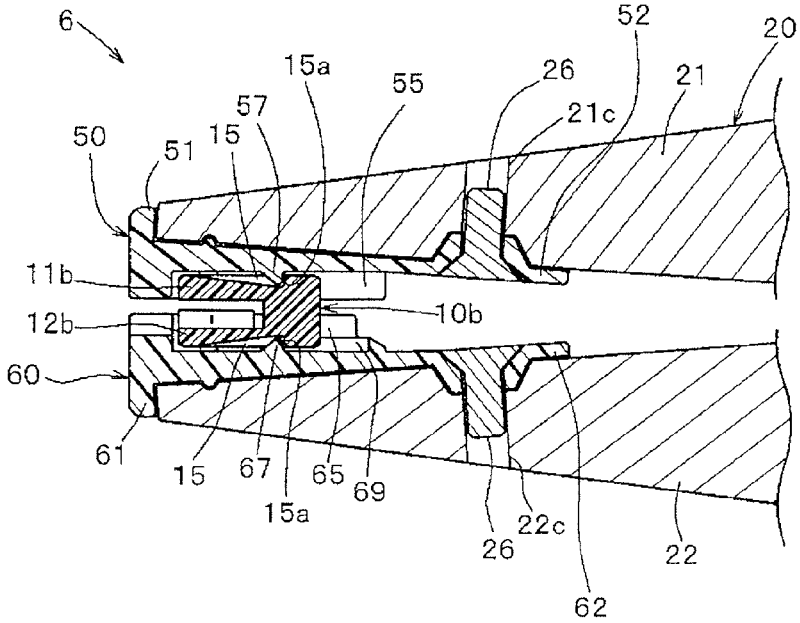
FIG. 15 is an explanatory view explaining a state where the slider body is held with the slider handling tool

FIG. 14 is a cross-sectional view of the slider body and the slider handling tool according to Example 2. FIG. 15 is an explanatory view explaining a state that the slider body is held with the slider handling tool.

Regarding a slider 6 of Example 2, an engaged concave part 15 is formed on an upper surface of the upper blade part 11*b* and a lower surface of the lower blade part 12*b* in the slider body 10*b*, a whole upper surface of the upper blade part 11*b* and a whole lower surface of the lower blade part 12*b* are not formed as a flat surface, and engaging convex parts 57 and 67 which are inserted into the engaged concave part 15 of the upper blade part 11*b* and the lower blade part 12*b* are respectively disposed on an upper supporting surface 54*a* of the first holding part 50 and a lower blade part supporting surface 64*a* of the second holding part 60, respectively.

It should be noted that the slider 6 of the Example 2 has a similar structure to the slider 5 of Example 1 as mentioned above except that the engaged concave part 15 and the engaging convex parts 57 and 67 are formed. Therefore, in Example 2, same numerals are used for parts having substantially same structures as the slider 5 of Example 1 to omit detailed explanations thereof. A specific explanation of a main structure of the slider 6 of Example 2 is described as below.

The slider 6 of Example 2 has a slider body 10*b* made of thermoplastic resin and slidably attached to the left and right element rows and a slider handling tool 20*b* holding the slider body 10*b* and performing sliding operation.

The slider body 10*b* of Example 2 has a simple structure having an upper blade part 11*b*, a lower blade part 12*b* disposed parallel to and at a determined interval with the upper blade part 11*b*, a guide post 13 connecting shoulder opening side end parts of the upper blade part 11*b* and the lower blade part 12*b* and a flange part 14 erecting on left and right side edge parts of the lower blade part 12*b*, and without a tab.

An engaged concave part (depression part) 15 is formed on a center part in a width direction on an upper surface side of the upper blade part 11*b* of Example 2 so as to recess from the upper surface of the upper blade part 11*b*. The engaged concave part 15 is formed from a position slightly back and interior of a front end (shoulder opening side end edge) of the upper blade part 11*b* to a back end (rear opening side end edge) of the upper blade part 11 along the front and back direction.

The engaged concave part 15 has a front wall surface 15*a* disposed substantially vertical along a top and bottom direction, a bottom surface extending from the front wall surface 15*a* via a curved part to rearward, and left and right wall surfaces disposed on respective left and right sides of the front wall surface 15*a* and the bottom surface. In this case, the bottom surface of the engaged concave part 15 is formed as a sloped surface which diagonally slopes with respect to the upper surface of the upper blade part 11*b* so that a depth of the bottom surface of the engaged concave part 15 from the upper surface of the upper blade part 11*b* is gradually decreased rearward.

Further, another engaged concave part (depression part) 15 is formed on a center part in a width direction on the lower surface side of the lower blade part 12*b* so as to recess from the lower surface of the lower blade part 12*b*. The engaged concave part 15 of the lower blade part 12*b* has a plane-symmetric shape in a top and bottom direction with respect to the engaged concave part 15 of the upper blade part 11*b*.

The slider handling tool 20 of Example 2 is formed by replacing the first and second holding parts 30 and 40 of the slider handling tool 20 in the above mentioned Example 1 with the first and second holding parts 50 and 60 made of synthetic resin and corresponding to the slider body 10*b* in Example 2.

The first holding part 50 in Example 2 has a first holding body 51 supporting the upper blade part 11*b* and a first extended fixing part 52 extending from the first holding body 51. The first holding body 51 has a tapered narrow shape in which a width dimension is gradually decreased from a base part to a tip end part, and is formed bilaterally symmetrical at a center line parallel to the first holding part 50 in a length direction.

The first holding body 51 has a bottom surface part 54 provided with an upper blade part supporting surface 54*a*, a pair of left and right side wall parts 55 disposed on left and right side edge parts of the first holding body 51, and a back wall part 56 disposed at a tip end part of the first holding body 51. An upper blade part storing concave part which can store the upper blade part 11*b* of the first holding body 51 is surrounded by the bottom surface part 54, the left and right side wall parts 55 and the back wall part 56.

The bottom surface part 54 of the first holding body 51 has an upper blade part supporting surface 54*a* contacting the upper surface of the upper blade part 11*b* and supporting the upper blade part 11*b* from the upper surface side and an engaging convex part 57 protruded on the upper blade part supporting surface 54*a*. The upper blade part supporting surface 54*a* has a main supporting surface disposed at a tip end part of the first holding body 51 and a guide surface which is disposed at a position closer to the first extended fixing part 52 side than a position of the main supporting surface and guides (introduces) the upper blade part 11*b* to the main supporting surface.

The engaging convex part 57 of the first holding part 50 is disposed on a center part of the width direction of the upper blade part supporting surface 54*a*. The engaging convex part 57 is disposed to contact and engage the front wall surface 15*a* of the engaged concave part 15 which is formed on the upper blade part 11*b* of the slider body 10, when the upper blade part 11*b* of the slider body 10*b* is contacted with the back wall part 56 of the first holding part 50.

The second holding part 60 of Example 2 has a second holding body 61 supporting the lower blade part 12*b* and a second extended fixing part 62 extending from the second holding body 61. The second holding body 61 has a tapered narrow shape in which a width dimension is gradually decreased from a base part to a tip end part, and is formed bilaterally symmetrical with respect to a center line parallel to the second holding part 60 in a length direction.

The second holding body 61 has a bottom surface part 64 provided with a lower blade part supporting surface 64*a*, a pair of left and right side wall parts 65 disposed on left and right side edge parts of the second holding body 61, a back wall part 66 disposed at a tip end part of the second holding body 61, and a raised part 69 disposed at a base end of the second holding body 61. A lower blade part storing concave part which can store the lower blade part 12*b* of the second holding body 61 is surrounded by the bottom surface part 64, the left and right side wall parts 65, the back wall part 66 and the raised part 69.

The bottom surface part 64 of the lower blade part storing concave part has a lower blade part supporting surface 64*a* contacting the lower surface of the lower blade part 12*b* and supporting the lower blade part 12*b* from a lower surface side and an engaging convex part 67 protruded on the lower blade part supporting surface 64*a*. The lower blade part supporting surface 64*a* has a main supporting surface disposed at a tip end part of the second holding body 61 and a guide surface which is disposed at a position closer to the second extended fixing part 62 side than a position of the main supporting surface and guides (introduces) the lower blade part 12*b* to the main supporting surface.

The engaging convex part 67 of the second holding part 60 is disposed to contact and engage the front wall surface 15*a* of the engaged concave part 15 which is formed on the lower blade part 12*b*, when the lower blade part 12*b* of the slider body 10*b* is contacted with the back wall part 66 of the second holding part 60.

It should be noted that the left and right side wall parts 55 and 65 and the back wall parts 56 and 66 of the first and second holding bodies 51 and 61 as well as the raised part 69 of the second holding body 61 in Example 2 are formed similar to the first and second holding bodies 31 and 41 in the above mentioned Example 1.

The first and second extended fixing parts 52 and 62 in Example 2 are formed similar to the first and second extended fixing parts 32 and 42 in the above mentioned Example 1. Further, a fitting groove part is formed on respective outer surfaces of the first and second holding parts 50 and 60 of Example 2, as in the fitting groove parts 38 and 48 in the above mentioned Example 1.

In the slider 6 of Example 2, a slider body 10*b* without having a tab can be held with the first and second holding parts 50 and 60 of the slider handling tool 20*b* at top and bottom surfaces of the slider body 10*b* and smoothly slid along the element rows in a closing direction, similar to Example 1.

At the time of sliding the slider body 10*b*, deformation or breakage of the upper blade part 11*b*, the lower blade part 12*b* or left and right flange parts 14 can be effectively prevented by supporting the slider body 10*b* with the slider handling tool 20*b*. Therefore, similar functional effects to that regarding the slider 5 of Example 1 can be obtained by the slider 6 of Example 2.

Particularly in Example 2, when the slider body 10*b* is held with the first and second holding parts 50 and 60, the respective engaging convex parts 57 and 67 of the first and second holding parts 50 and 60 are engaged to and stuck with the respective engaged concave parts 15 of the upper and lower blade parts 11*b* and 12*b*, as shown in FIG. 15. Therefore, the slider body 10*b* can be held firmly with the slider handling tool 20*b* and slid more stably along the element rows in a closing direction.

It should be noted that in the slider 6 of Example 2, the engaged concave part 15 is provided to both the upper blade part 11*b* and the lower blade part 12*b* of the slider body 10*b*, and the engaging convex parts 57 and 67 are provided to both the first and second holding parts 50 and 60 of the slider handling tool 20*b*.

In the present invention, however, it is possible to provide the engaged concave part 15 to either of the upper or lower blade part 11*b* or 12*b* and to provide the engaging convex part 57 or 67 to either of the first or second holding part 50 or 60 corresponding to the upper or lower blade part 11*b* or 12*b* to which the engaged concave part 15 is provided.

In addition, it is possible to provide not the engaged concave part 15 but an engaged convex part protruding from the upper surface of the upper blade part 11*b* or the lower surface of the lower blade part 12*b* to the upper or lower blade parts 11*b* or 12*b* of the slider body 10*b* and to provide not the engaging convex part 57 or 67 but an engaging concave part corresponding to the engaged convex part to the first holding part 50 and/or the second holding part 60 of the slider handling tool 20*b*.

EXAMPLE 3

Figure 16:
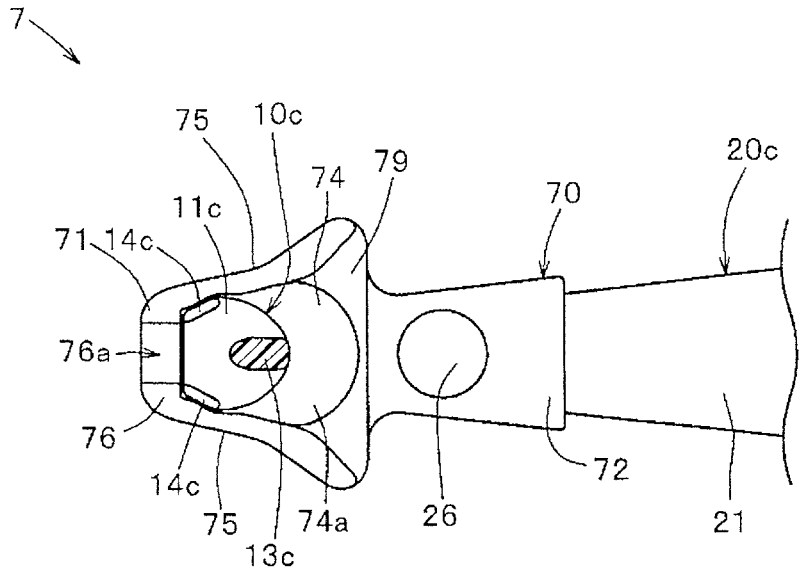
FIG. 16 is a cross-sectional view showing the slider body and the slider handling tool according to Example 3.
Figure 17:
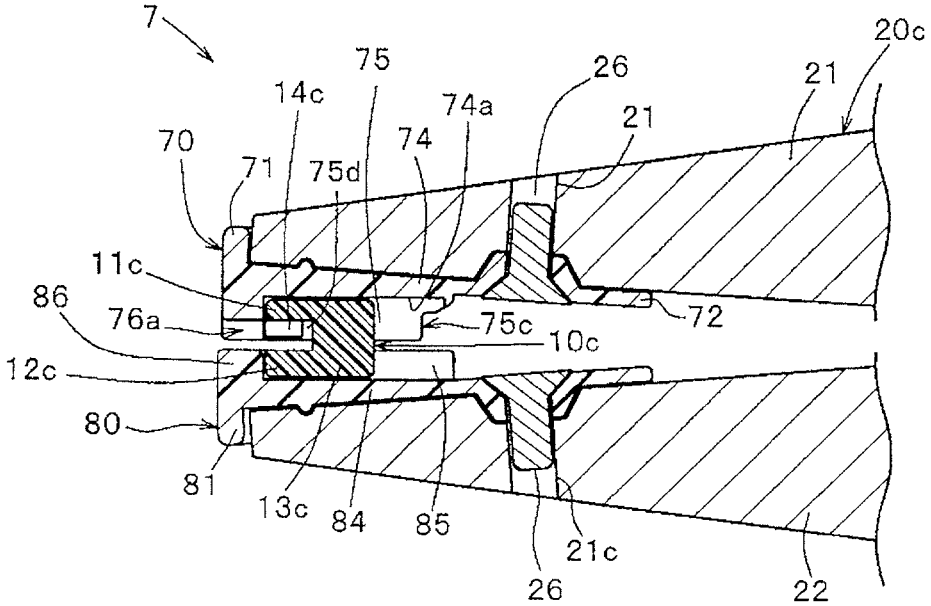
FIG. 17 is an explanatory view explaining a state where the slider body is held with the slider handling tool.
Figure 18:
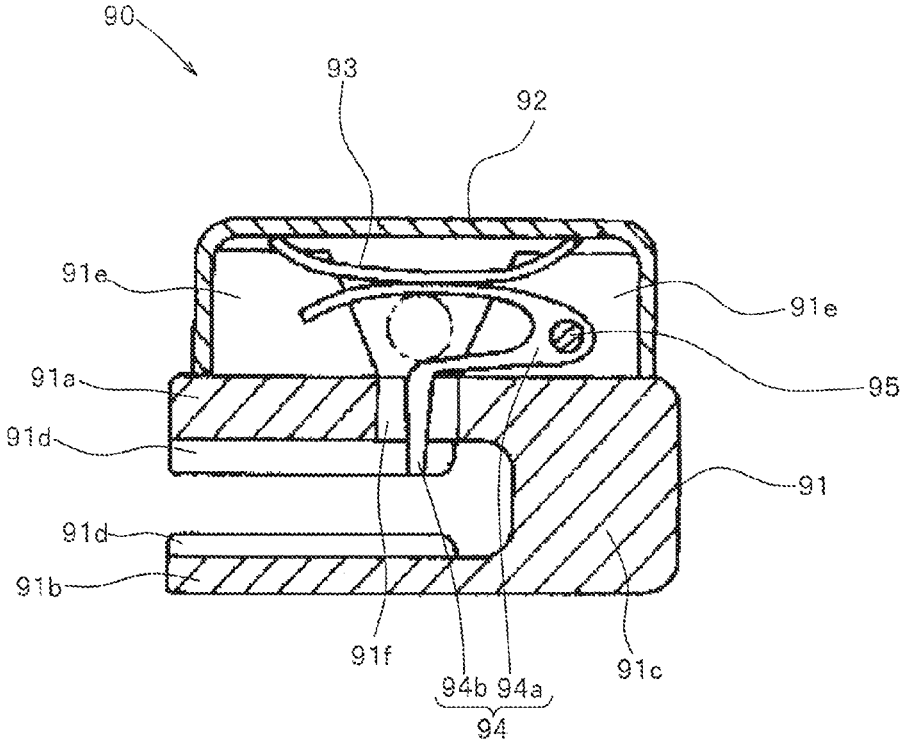
FIG.18 PRIOR ART
FIG. 18 is a cross-sectional view of a conventional slider body.
Figure 19:
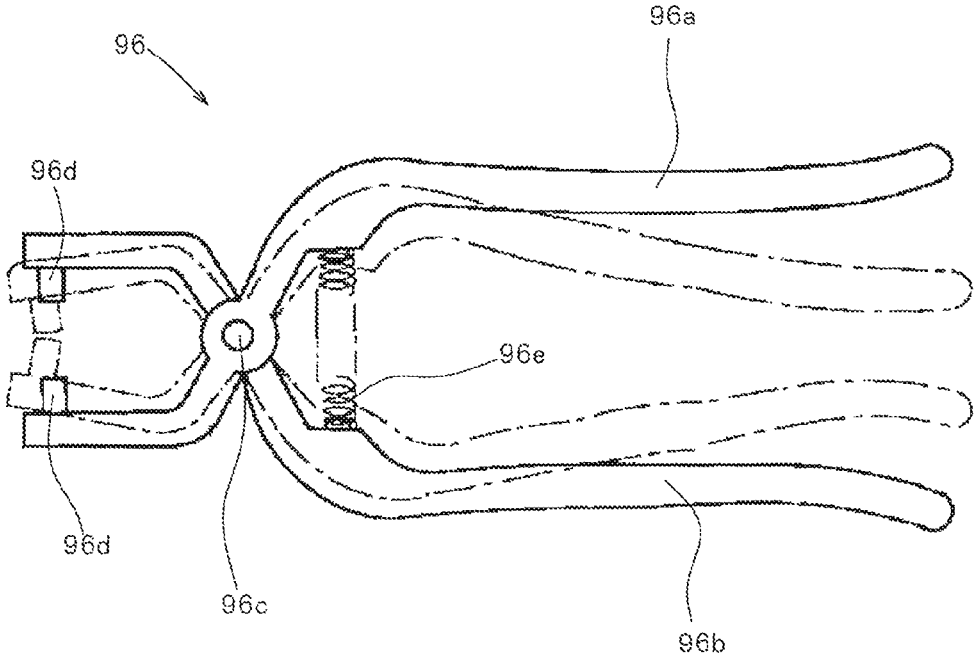
FIG.19 PRIOR ART
FIG. 19 is an overall view of a conventional tab tool

FIG. 16 is a cross-sectional view of a slider body and a slider handling tool regarding Example 3. FIG. 17 is an explanatory view explaining a state that the slider body is held with the slider handling tool.

The slide fastener of Example 3 includes a pair of left and right fastener stringers in which coil-like element rows are formed on a surface of a tape along facing tape side edge parts of left and right fastener tapes, first and second stopping elements disposed adjacent to the element rows at front and back end parts of each fastener stringer, and a slider body 10*c* disposed slidably along the element rows, which are not shown. Further, in the slide fastener of Example 3, a slider handling tool 20*c* for sliding operation of the slider body 10*c* as a slider 7 is independently prepared from the slider body 10*c*.

The left and right fastener stringers in Example 3 are formed as fastener stringers for a general type "top surface" slide fastener in which the element rows are formed to be positioned on an outer surface side of a fastener attached product, and the slider 7 of Example 3 is also formed for a general type "top surface" slide fastener.

The slider body 7 of Example 3 has, as mentioned above, a slider body 10*c* made of thermoplastic resin and a slider handling tool 20*c* holding and performing sliding operation of the slider body 10*c*.

The slider body 10*c* includes an upper blade part 11*c*, a lower blade part 12*c* disposed parallel to the upper blade part 11*c* at a predetermined interval, a guide post 13*c* connecting a shoulder opening side end part (front end part) of the upper blade part 11*c* and a shoulder opening side end part (front end part) of the lower blade part 12*c* and a flange part 14*c* standing on left and right side edge parts of the upper blade part 11*c*.

Particularly, the slider body 10*c* of Example 3 has a simple structure that a tab attaching post which is attached to a conventional general slider body is removed, and that the slider body is short in a length direction as a latter half of a conventional general slider body is removed.

The slider handling tool 20*c* of Example 3 is formed by replacing the first and second holding parts 30 and 40 of the slider handling tool 20 in the above mentioned Example 1 with first and second holding parts 70 and 80 made of synthetic resin and corresponding to the slider body 10*c* of Example 3.

The first holding part 70 in Example 3 has a first holding body 71 supporting the upper blade part 11*c* and a first extended fixing part 72 extending from the first holding body 71. The first extended fixing part 72 and a second extended fixing part 82 of Example 3, as mentioned later, are formed similar to the first extended fixing part 32 and the second extended fixing part 42 of Example 1. Fitting groove parts are formed on an outer surface of the first holding part 70 and the second holding part 80 to enable a tip end part of the first arm part 21 or the second arm part 22 fitting in, similar to the fitting groove parts 38 and 48 in the above mentioned Example 1.

The first holding body 71 of Example 3 has a bottom surface part 74 provided with an upper blade part supporting surface 74*a*, a pair of left and right side wall parts 75 disposed at left and right side edge parts of the first holding body 71, a pair of left and right flange regulating parts 75*d* which protrude integrally from the left and right side wall parts 75 and support an outside of the left and right flange parts 14*c* of the slider body 10*c*, a back wall part 76 disposed at a tip end part of the first holding body 71, and a raised part 79 disposed at a base end part of the first holding body 71. An upper blade part storing concave part which can store the upper blade part 11*c* of the first holding body 71 is surrounded by the bottom surface part 74, the left and right side wall parts 75, the back wall part 76 and the raised part 79.

The bottom surface part 74 of the first holding body 71 has a single flat surface (inner surface) having a larger area than a flat upper surface of the upper blade part 11*c* as an upper blade part supporting surface 74*a*. The upper blade part supporting surface 74*a* has a main supporting surface which supports the upper surface of the upper blade part 11*c* when the upper blade part 11*c* is contacted with the back wall part 76 of the first holding body 71 and a guide surface which is disposed between the left and right side wall parts 75 and guides (leads) the upper blade part 11*c* to the main supporting surface.

The left and right side wall parts 75 of the first holding body 71 are formed at the left and right side edge parts of the first holding body 71 to extend in a direction substantially perpendicular to the upper blade part supporting surface 74*a*, and continuously from a tip end of the first holding body 71 to a base end.

The left and right side wall parts 75 has a supporting part which is disposed at a tip end part of the first holding body 71 and contacts or approaches left and right side edges of the upper blade part 11*c* when a back end edge of the upper blade part 11*c* is contacted with the back wall part 76 of the first holding body 71, and an enlarged width part which extends from the supporting part to a base end part side and gradually increases an interval between the left and right side wall parts 75 toward the base end part.

The left and right flange regulating parts 75*d* are formed by an upper end part of respective side wall parts 75 and integrated with the side wall parts 75 so as to support an outside of the left and right flange parts 14*c* of the slider body 10*c*.

The back wall part 76 of the first holding body 71 is formed at a tip end part of the first holding body 71 to bridge the left and right side wall parts 75 along a width direction. An insertion hole part 76*a* which enables the coupled left and right element rows to pass is formed on an upper end part (tip end part) of the back wall part 76.

In a conventional general slider body, when left and right element rows are coupled, a latter half part of the slider body has a function to stabilize a coupling state of the left and right element rows which are coupled in an element guideway. On the other hand, the slider body 10*c* of Example 3 is formed such that a latter half part of the conventional general slider body is removed, as mentioned above. It is short in a length direction and has a simple structure, and the back wall part 76 of the first holding part 70 of Example 3 has a structure having the insertion hole part 76*a*, as mentioned above.

With the above structure, when the slider body 10*c* is held with the first and second holding parts 70 and 80 of the slider handling tool 20 at a predetermined position, the back wall part 76 of the first holding body 70 can play a roll of stabilizing a coupling state of the element rows instead of the latter half part of the conventional general slider body. That is, in Example 3, a coupling state of the element rows coupled in the element guideway of the slider body 10*c* can be stabilized by passing the insertion hole part 76*a* provided on the back wall part 76 of the first holding part 70.

The raised part 79 of the first holding body 71 is disposed on a base end part of the first holding body 71 between the left and right side wall parts 75, and has a smaller height dimension from the bottom surface part 74 (upper blade part supporting surface 74*a*) than that of the side wall parts 75. An inner wall surface of the raised part 79 is formed as a curved surface to be a semicircular shape when viewed from a side of the second holding part 80.

The second holding part 80 of Example 3 has a second holding body 81 supporting the lower blade part 12*c* and a second extended fixing part 82 extending from the second holding body 81. The second holding body 81 has a bottom surface part 84 provided with a lower blade part supporting surface, a pair of left and right side wall parts 85 disposed on left and right side edge parts of the second holding body 81, and a back wall part 86 disposed at a tip end part of the second holding body 81. In this case, a lower blade part storing concave part which can store the lower blade part 12*c* of the second holding body 81 is surrounded by the bottom surface part 84, the left and right side wall parts 85, and the back wall part 86.

The bottom surface part 84 of the second holding body 81 has a single flat surface (inner surface) having a larger area than a flat lower surface of the lower blade part 12*c* as a lower blade part supporting surface. The lower blade part supporting surface has a main supporting surface which supports the lower surface of the lower blade part 12*c* when the lower blade part 12*c* is contacted with the back wall part 86 of the second holding body 81 and a guide surface which is disposed between later-mentioned enlarged width parts of the left and right side wall parts 85 and guides (leads) the lower blade part 12*c* to the main supporting surface of the lower blade part 12*c*.

The left and right side wall parts 85 of the second holding body 81 are formed at the left and right side edge parts of the second holding body 81 to extend in a direction substantially perpendicular to the lower blade part supporting surface, and continuously from a tip end of the second holding body 81 to a base end.

Further, the left and right side wall parts have a supporting part which is disposed at a tip end part of the second holding body 81 and contacts or approaches left and right side edges of the lower blade part 12*c* when a back end edge of the lower blade part 12 is contacted with the back wall part 86 of the second holding body 81, and an enlarged width part which extends from the supporting part to a base end part side and gradually increases an interval between the left and right side wall parts 85 toward the base end part.

By using the slider handling tool 20*c* to the slider 7 of Example 3, a slider body 10*c* without having a tab can be held with the first and second holding parts 70 and 80 of the slider handling tool 20*c* at top and bottom surfaces and smoothly slid along the element rows in a closing direction.

At the time of sliding the slider body 10*c*, deformation or breakage of the upper blade part 11*c*, the lower blade part 12*c* or left and right flange parts 14*c* can be effectively prevented by supporting the slider body 10*b* with the slider handling tool 20*c*. Therefore, similar functional effects to those of the slider 5 of Example 1 can be obtained by the slider 7 of Example 3.

REFERENCE SIGNS LIST

1 Slide fastener
2 Fastener stringer
3 Fastener tape
4 Element row
5, 6, 7 Slider
10 Slider body
10*b*, 10*c* Slider body
11 Upper blade part
11*b*, 11*c* Upper blade part
12 Lower blade part
12*b*, 12*c* Lower blade part
13, 13*c* Guide post
14, 14*c* Flange part
15 Engaged concave part (depression part)
15*a* Front wall surface
20, 20*a* Slider handling tool
20*b*, 20*c* Slider handling tool
21 First arm part
21*a* First concave part
21*b* Second concave part
21*c* Screw hole part
22 Second arm part
22*a* First concave part
22*b* Second concave part
22*c* Screw hole part
23 Connecting axis part
24 First grip part
25 Second grip part
26 Bolt
27 Fixing member
30, 30*a* First holding part (upper blade part holding part)
31 First holding body
32 First extended fixing part
33 Upper blade part storing concave part (first storing concave part)
34 Bottom surface part
34*a* Upper blade part supporting surface
35 Side wall part
35*a* Supporting part
35*b* Enlarged width part
36 Back wall part
37 Fixing hole part
37*a* Head fitting part
37*b* Screw part
38 Fitting groove part
38*a* First ridge part
38*b* Second ridge part
39 Fitting groove part
40 Second holding part (lower blade part holding part)
41 Second holding body
42 Second extended fixing part
43 Lower blade part storing concave part (second storing concave part)
44 Bottom surface part
44*a* Lower blade part supporting surface
45 Side wall part
45*a* Supporting part
45*b* Enlarged width part
45*c* Introducing part
45*d* Flange regulating part
46 Back wall part
46*a* Insertion hole part
47 Fixing hole part
47*a* Head fitting part
47*b* Screw part
48 Fitting groove part
48*a* First ridge part
48*b* Second ridge part
49 Raised part
50 First holding part
51 First holding body
52 First extended fixing part
54 Bottom surface part
54*a* Upper blade part supporting surface
55 Side wall part
56 Back wall part
57 Engaging convex part
60 Second holding part
61 Second holding body
62 Second extended fixing part
64 Bottom surface part
64*a* Lower blade part supporting surface
65 Side wall part
66 Back wall part
67 Engaging convex part
69 Raised part
70 First holding part
71 First holding body
72 First extended fixing part
74 Bottom surface part
74*a* Upper blade part supporting surface
75 Side wall part
75*c* Introducing part
75*d* Flange regulating part
76 Back wall part
76*a* Insertion hole part
79 Raised part
80 Second holding part
81 Second holding body
82 Second extended fixing part
84 Bottom surface part
85 Side wall part
86 Back wall part

What is claimed is:

1. A slider for a slide fastener including a synthetic resin slider body which is attached to left and right element rows and can couple and separate the element rows each other by sliding along the left and right element rows, wherein the slider body includes an upper blade part, a lower blade part disposed parallel to the upper blade part at a predetermined interval, a guide post connecting a shoulder opening side end part of the upper blade part and a shoulder opening side end part of the lower blade part and a flange part disposed at left and right side edge parts of at least one of the upper blade part and the lower blade part, wherein the slider includes a slider handling tool which holds top and bottom sides of the slider body and performs sliding operation with respect to the element rows, the slider handling tool includes a first arm part and a second arm part which cross and connect each other swingably at a crossed point with a connecting axis part, a first grip part and a second grip part disposed at one end part of the first arm part and the second arm part, and a first holding part and a second holding part disposed at the other end part of the first arm part and the second arm part and holding the top and bottom sides of the slider body, and the first and second holding parts respectively have a back wall part supporting each back surface of the upper and lower blade parts.

2. The slider according to claim 1, wherein the first holding part has an upper blade part supporting surface which supports a whole upper surface of the upper blade part, and the second holding part has a lower blade part supporting surface which supports a whole lower surface of the lower blade part.

3. The slider according to claim 1, wherein the slider body has an engaged concave part or an engaged convex part which is provided on at least one of the upper surface of the upper blade part and the lower surface of the lower blade part, and the first holding part has an upper blade part supporting surface supporting the upper surface of the upper blade part, the second holding part has a lower blade part supporting surface supporting the lower surface of the lower blade part, and at least one of the first holding part and the second holding part has an engaging convex part or an engaging concave part which engages the engaged concave part or the engaged convex part.

4. The slider according to claim 3, wherein the upper surface of the upper blade part and the lower surface of the lower blade part are respectively formed on a single flat surface.

5. The slider according to claim 3, wherein the upper blade part supporting surface of the first holding part has a larger area than the upper surface of the upper blade part, and the lower blade part supporting surface of the second holding part has a larger area than the lower surface of the lower blade part.

6. The slider according to claim 1, wherein left and right side wall parts which support left and right side surface parts of the upper blade part are disposed at left and right side edge parts of the first holding part, and left and right side wall parts which support left and right side surface parts of the lower blade part are disposed at left and right side edge parts of the second holding part, and wherein the left and right side wall parts in the first holding part respectively have an enlarged width part which an interval between the left and right side wall parts is gradually increased toward a base end part side of the first holding part, and the left and right side wall parts in the second holding part respectively have an enlarged width part which an interval between the left and right side wall parts is gradually increased toward a base end part side of the second holding part.

7. The slider according to claim 1, wherein at least one of the first holding part and the second holding part has left and right flange regulating parts supporting an outside of the flange part of the slider body.

8. The slider according to claim 1, wherein the first holding part and the second holding part are attached respectively to the first arm part and the second arm part in a detachable manner.

9. The slider according to claim 1, wherein the first holding part and the second holding part respectively have a tapered shape whose dimension in a width direction is gradually decreased toward a tip end part.

10. A slider handling tool for sliding operation of the slider body according to claim 1 including a first arm part and a second arm part which cross and connect each other swingably at the crossed point with a connecting axis part, a first grip part and a second grip part disposed at one end part of the first arm part and the second arm part and a first holding part and a second holding part which are disposed on the other end part of the first arm part and the second arm part and hold top and bottom sides of the slider body, wherein the first and second holding parts respectively have a back wall part supporting each back surface of the upper and lower blade parts, and the slider body is slid while being held with the first holding part and the second holding part.

11. The slider handling tool according to claim 10, wherein left and right side wall parts which support left and right side surface parts of the upper blade part are disposed at left and right side edge parts of the first holding part, and left and right side wall parts which support left and right side surface parts of the lower blade part are disposed at left and right side edge parts of the second holding part.

12. A slider for a slide fastener including a synthetic resin slider body which is attached to left and right element rows and can couple and separate the element rows each other by sliding along the left and right element rows, wherein the slider body includes an upper blade part, a lower blade part disposed parallel to the upper blade part at a predetermined interval, a guide post connecting a shoulder opening side end part of the upper blade part and a shoulder opening side end part of the lower blade part and a flange part disposed at left and right side edge parts of at least one of the upper blade part and the lower blade part, wherein the slider includes a slider handling tool which holds top and bottom sides of the slider body and performs sliding operation with respect to the element rows, the slider handling tool includes a first arm part and a second arm part which cross and connect each other swingably at a crossed point with a connecting axis part, a first grip part and a second grip part disposed at one end part of the first arm part and the second arm part, and a first holding part and a second holding part disposed at the other end part of the first arm part and the second arm part and holding the top and bottom sides of the slider body, and left and right side wall parts which support left and right side surface parts of the upper blade part are disposed at left and right side edge parts of the first holding part, and left and right side wall parts which support left and right side surface parts of the lower blade part are disposed at left and right side edge parts of the second holding part.

* * * * *